US007909282B2

(12) United States Patent
Wojcik et al.

(10) Patent No.: US 7,909,282 B2
(45) Date of Patent: Mar. 22, 2011

(54) CENTER/SURFACE REWINDER AND WINDER

(75) Inventors: Steven James Wojcik, Mosinee, WI (US); Dennis Marvin Jobs, Appleton, WI (US); Kenneth Allen Pigsley, Greenville, WI (US); James Leo Baggot, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 414 days.

(21) Appl. No.: 11/799,043

(22) Filed: Apr. 30, 2007

(65) Prior Publication Data

US 2008/0061182 A1 Mar. 13, 2008

Related U.S. Application Data

(63) Continuation-in-part of application No. 10/085,813, filed on Feb. 28, 2002.

(51) Int. Cl.
*B65H 35/10* (2006.01)
*B65H 35/08* (2006.01)

(52) U.S. Cl. ..... 242/521; 242/526.1

(58) Field of Classification Search ..... 242/526.1, 242/542, 542.1, 542.4, 521; 225/1, 93, 100, 225/101, 103, 106; 226/190
See application file for complete search history.

(56) References Cited

U.S. PATENT DOCUMENTS

| | | | | |
|---|---|---|---|---|
| 125,597 | A | | 4/1872 | Mayall |
| 1,648,990 | A | | 11/1927 | Little |
| 1,894,253 | A | | 1/1933 | McCarthy et al. |
| 2,326,173 | A | | 8/1943 | Russell |
| 2,328,582 | A | * | 9/1943 | Ratchford et al. ..... 225/5 |
| 2,979,278 | A | | 4/1961 | Jones |
| 3,123,315 | A | | 3/1964 | Couzens |
| 3,148,843 | A | * | 9/1964 | Turner et al. ..... 242/521 |
| 3,157,371 | A | | 11/1964 | Billingsley |
| 3,315,908 | A | | 4/1967 | Wetzler |
| 3,430,881 | A | | 3/1969 | Ebneter |
| 3,519,214 | A | | 7/1970 | Konrad et al. |
| RE28,353 | E | | 3/1975 | Nystrand |
| 3,869,095 | A | | 3/1975 | Diltz |
| 4,034,928 | A | | 7/1977 | McDonald et al. |

(Continued)

FOREIGN PATENT DOCUMENTS

CH 4 76620 9/1969

(Continued)

OTHER PUBLICATIONS

U.S. Patent Application, U.S. Appl. No. 10/003,715, filed Oct. 31, 2001.

(Continued)

*Primary Examiner* — William E Dondero
(74) *Attorney, Agent, or Firm* — Dority & Manning, P.A.

(57) ABSTRACT

A winder for winding a web to produce a rolled product is provided. The winder includes a web transport apparatus that is used for conveying the web. Also included in one exemplary embodiment is a plurality of independent winding modules. The winding modules are independently positioned to independently engage the web as the web is conveyed by the web transport apparatus. The winding modules may be configured to wind the web to form a rolled product by center winding, surface winding, and combinations of center and surface winding. The winding modules are structurally and operationally independent of one another where if one module is disabled, another may still operate to produce the rolled product without shutting down the winder.

13 Claims, 24 Drawing Sheets

U.S. PATENT DOCUMENTS

| | | | | |
|---|---|---|---|---|
| 4,087,319 | A | | 5/1978 | Linkletter |
| 4,133,495 | A | | 1/1979 | Dowd |
| 4,139,164 | A | | 2/1979 | Alfio |
| 4,143,828 | A | | 3/1979 | Braun et al. |
| 4,191,341 | A | | 3/1980 | Looser |
| 4,283,023 | A | | 8/1981 | Braun et al. |
| 4,327,876 | A | | 5/1982 | Kuhn |
| 4,529,141 | A | | 7/1985 | McClenathan |
| 4,541,583 | A | | 9/1985 | Forman et al. |
| 4,583,698 | A | | 4/1986 | Nistri et al. |
| 4,588,138 | A | | 5/1986 | Spencer |
| 4,723,724 | A | | 2/1988 | Bradley |
| 4,856,725 | A | | 8/1989 | Bradley |
| 4,930,711 | A | | 6/1990 | Morizzo |
| 4,962,897 | A | | 10/1990 | Bradley |
| 4,988,052 | A | | 1/1991 | Urban |
| 5,169,084 | A | | 12/1992 | Pötter et al. |
| 5,226,612 | A | | 7/1993 | Mülfarth |
| 5,346,150 | A | | 9/1994 | Volin |
| 5,379,964 | A | | 1/1995 | Pretto et al. |
| 5,402,960 | A | | 4/1995 | Oliver et al. |
| 5,421,536 | A | | 6/1995 | Hertel et al. |
| 5,437,417 | A | | 8/1995 | Kammann |
| 5,497,959 | A | | 3/1996 | Johnson et al. |
| 5,505,402 | A | | 4/1996 | Vigneau |
| 5,518,200 | A | | 5/1996 | Kaji et al. |
| 5,531,396 | A | | 7/1996 | Kinnunen et al. |
| 5,593,545 | A | | 1/1997 | Rugowski et al. |
| 5,746,379 | A | | 5/1998 | Shimizu |
| 5,832,696 | A | | 11/1998 | Nagy et al. |
| 5,839,688 | A | | 11/1998 | Hertel et al. |
| 5,901,918 | A | | 5/1999 | Klerelid et al. |
| 5,918,830 | A | | 7/1999 | Veräjänkorva et al. |
| 5,944,273 | A | | 8/1999 | Lin et al. |
| 5,979,818 | A | * | 11/1999 | Perini et al. ..... 242/521 |
| 6,050,469 | A | * | 4/2000 | Brabant et al. ..... 226/183 |
| 6,056,229 | A | | 5/2000 | Blume et al. |
| 6,062,507 | A | | 5/2000 | Summey, III |
| 6,142,407 | A | | 11/2000 | McNeil et al. |
| 6,264,132 | B1 | | 7/2001 | Menz et al. |
| 6,283,402 | B1 | | 9/2001 | Fordham |
| 6,308,909 | B1 | * | 10/2001 | McNeil et al. ..... 242/527.4 |
| 6,311,921 | B1 | | 11/2001 | Möller et al. |
| 6,332,589 | B1 | | 12/2001 | Moller et al. |
| 6,523,775 | B2 | | 2/2003 | Fan |
| 6,595,458 | B1 | * | 7/2003 | Biagiotti ..... 242/532.2 |
| 7,000,864 | B2 | | 2/2006 | McNeil et al. |
| 2003/0037725 | A1 | | 2/2003 | Daul et al. |
| 2003/0160127 | A1 | | 8/2003 | Wojcik et al. |
| 2004/0061021 | A1 | | 4/2004 | Butterworth |
| 2005/0087647 | A1 | * | 4/2005 | Butterworth et al. ..... 242/521 |
| 2007/0241160 | A1 | * | 10/2007 | Kenney ..... 225/100 |

FOREIGN PATENT DOCUMENTS

| | | | |
|---|---|---|---|
| DE | 3 920659 | A1 | 1/1999 |
| EP | 0 118384 | A1 | 9/1984 |
| EP | 0 198495 | A2 | 10/1986 |
| EP | 0 313859 | A2 | 5/1989 |
| EP | 0 408526 | B1 | 1/1991 |
| EP | 0 658504 | A2 | 6/1995 |
| EP | 1 006066 | A2 | 11/1999 |
| EP | 1 076130 | A2 | 2/2001 |
| EP | 1 262 434 | | 12/2002 |
| EP | 1 273 540 | | 1/2003 |
| FR | 2 669013 | | 5/1992 |
| WO | WO 9 852857 | A1 | 11/1998 |
| WO | WO 9 855384 | | 12/1998 |
| WO | WO 0 047503 | | 8/2000 |
| WO | WO 0 066470 | | 11/2000 |
| WO | WO 0 2055420 | A1 | 7/2002 |

OTHER PUBLICATIONS

PCT Search Report and Written Opinion for Application No. PCT/US 03/02264; Filed Jan. 24, 2003.

Communication Relating to the Results of the Partial International Search, Jul. 28, 2008.

* cited by examiner

CENTER/SURFACE REWINDER AND WINDER

RELATED APPLICATIONS

The present application claims priority to and is a continuation-in-part application of U.S. patent application Ser. No. 10/085,813, filed on Feb. 28, 2002.

BACKGROUND

Winders are machines that roll lengths of paper, commonly known as paper webs, into rolls. These machines are capable of rolling lengths of web into rolls at high speeds through an automated process. Turret winders are well known in the art. Conventional turret winders comprise a rotating turret assembly which support a plurality of mandrels for rotation about a turret axis. The mandrels travel in a circular path at a fixed distance from the turret axis. The mandrels engage hollow cores upon which a paper web can be wound. Typically, the paper web is unwound from a parent roll in a continuous fashion, and the turret winder rewinds the paper web onto the cores supported on the mandrels to provide individual, relatively small diameter logs. The rolled product log is then cut to designated lengths into the final product. Final products typically created by these machines and processes are toilet tissue rolls, paper toweling rolls, paper rolls, and the like.

The winding technique used in turret winders is known as center winding. A center winding apparatus, for instance, is disclosed in U.S. Patent Reissue No. 28,353 to Nystrand, which is incorporated herein by reference. In center winding, a mandrel is rotated in order to wind a web into a roll/log, either with or without a core. Typically, the core is mounted on a mandrel that rotates at high speeds at the beginning of a winding cycle and then slows down as the size of the rolled product being wound increases, in order to maintain a constant surface speed, approximately matching web speed. Center winders work well when the web that is being wound has a printed, textured, or slippery surface. Also, typically, center winders are preferable for efficiently producing soft-wound, higher bulk rolled products.

A second type of winding is known in the art as surface winding. A machine that uses the technique of surface winding is disclosed in U.S. Pat. No. 4,583,698. Typically, in surface winding, the web is wound onto the core via contact and friction developed with rotating rollers. A nip is typically formed between two or more co-acting roller systems. In surface winding, the core and the web that is wound around the core are usually driven by rotating rollers that operate at approximately the same speed as the web speed. Surface winding is preferable for efficiently producing hard-wound, lower bulk rolled products.

A problem found in both center and surface winders involves the winder shutting down when a condition such as a core load fault or a web break fault occurs. If a core on a turret winder, for instance, is not properly loaded onto the mandrel, the machine must shut down for the fault to be corrected. Similarly, a web break fault in a surface winder will also result in shutting the machine down. This results in a production loss and the immediate requirement to obtain repair services. The present invention provides a way of eliminating such problems by allowing the machine to continue to produce rolled product even though a fault condition has occurred. Additionally, the invention incorporates the advantages of both center and surface winding to produce rolled products having various characteristics by using either center winding, surface winding, or a combination of center and surface winding.

In the prior art, a winder is typically known as an apparatus that performs the very first wind of that web, generally forming what is known as a parent roll. A rewinder, on the other hand, is an apparatus that winds the web from the parent roll onto a roll that is essentially the finished product. It is to be noted, the prior art is not consistent in designating what is and is not a winder or rewinder. For instance, rewinders are sometimes called winders, and winders are sometimes referred to as rewinders.

SUMMARY

Objects and advantages of the invention will be set forth in part in the following description, or may be obvious from the description, or may be learned from practice of the present invention.

As used herein, "winder" is generic to a machine for forming a parent roll, and a machine (rewinder) for forming a roll/log from a parent roll. In other words, the word "winder" is broad enough to cover both a "winder" and "rewinder".

The present invention may include a web transport apparatus for conveying a web to a winder for winding the web to produce a rolled product. Also, a plurality of independent winding modules may be present. The winding modules are independently positioned to independently engage the web as it is conveyed by the web transport apparatus. The winding modules engage the web and wind the web to form a rolled product. The winding modules are configured to wind using center winding, surface winding, or a combination of center and surface winding. The winding modules are controlled and positioned independent of one another. Therefore, if one winding module is disabled another winding module may still operate to produce the rolled product without having to shut down the winder.

Also according to the present invention, a winder is disclosed as above where the plurality of independent winding modules may each have a core loading apparatus and a product stripping apparatus.

Also disclosed according to the present invention is a winder as set forth above where the plurality of independent winding modules each have a center driven mandrel onto which the web is wound to form the rolled product.

Also disclosed according to the present invention, is a method of producing a rolled product from a web. This method includes the step of conveying the web by a web transport apparatus. Another step in the method of the present invention may involve winding the web into the rolled product by using one or more winding modules. This may involve winding the web by one or more winding modules of the plurality of winding modules at any given time. The process that is used to wind the web may be center winding, surface winding, or a combination of both center and surface winding. The winding modules may act independently of one another to allow one or more winding modules to still wind the web to produce a rolled product without having to shut down the plurality of winding modules if any of the remaining winding modules fault or are disabled. The method according to the present invention also includes the step of transporting the rolled product from the winding module.

Another exemplary embodiment of the present invention may include a winder that is used for winding a web to produce a rolled product that has a web transport apparatus for conveying a web. This exemplary embodiment also has a plurality of independent winding modules mounted within a frame where each winding module has a positioning apparatus for moving the winding module into engagement with the web. Each winding module also has a mandrel that is rotated onto which the web is wound to form the rolled product. The winding modules are operationally independent of one another where if any of the winding modules are disabled, the remaining winding modules could continue to operate to produce the rolled product without having to shut down the winder. The rotational speed of the mandrel and the distance between the mandrel and the web transport apparatus may be controlled so as to produce a rolled product with desired characteristics. The winding modules are configured to wind the web by center winding, surface winding, and combinations of center and surface winding.

Another aspect of the present invention includes an exemplary embodiment of the winder as immediately discussed where each winding module may have a core loading apparatus for loading a core onto the mandrel. This exemplary embodiment also has a rolled product stripping apparatus for removing the rolled product from the winding module.

For example, in one embodiment, the core loading apparatus may comprise a core loading assembly slidably mounted on a mandrel. The core loading assembly may include a gripping device and a stabilizer. The gripping device can include at least two gripping members that are movable towards and away from each other. For instance, the gripping members may be pneumatically or hydraulically actuated. The stabilizer, on the other hand, can be slidably engaged on the mandrel for stabilizing the mandrel as the gripping device pulls a core onto the mandrel. The stabilizer, for instance, may have a configuration similar to the gripping device. The stabilizer may include at least two stabilizing members that are movable towards and away from each other and that surround the mandrel. Similar to the gripping device, the stabilizing members can be pneumatically or hydraulically actuated.

The core loading assembly can be attached to an actuator that is configured to move the core loading assembly back and forth across the mandrel. In this embodiment, in order to load a core onto the mandrel, the gripping members of the gripping device engage a core at the first end of the mandrel while the actuator moves the core loading assembly towards the second end of the mandrel thereby pulling a core onto the mandrel. The actuator, for instance, may comprise a linear track that is powered by a servo motor.

In one embodiment, the gripping members have a shape that surrounds a substantial portion of the core as it is pulled across the mandrel. For instance, the gripping members may define a rectangular-like cross-sectional shape that is configured to engage a core without harming the core.

In one embodiment, a controller, such as a microprocessor, may be placed in communication with the actuator and the core loading assembly. The controller can be configured to load a core onto the mandrel according to a predetermined sequence for positioning the core at a particular location.

Once the core is loaded on the mandrel, a web of material is wound onto the core to form a roll. In one embodiment, the core loading assembly can be used also to push a formed roll off the mandrel.

Another aspect of the present disclosure is directed to an apparatus for breaking a moving web while the web is being wound onto the mandrels. In particular, the apparatus for breaking the web is particularly well suited to breaking the web in order to form a new leading edge without having to stop or slow down the web.

In one embodiment, for instance, the apparatus can include a first rotating arm and a second rotating arm that are positioned adjacent to a conveying surface. The first rotating arm can be spaced upstream from the second rotating arm. The first rotating arm defines a first contact surface that contacts the conveying surface when the arm is rotated and the second rotating arm defines a second contact surface that also contacts the conveying surface when the arm is rotated.

In order to break a moving web on the conveying surface, both arms are rotated causing each of the contact surfaces to contact the moving web on the conveying surface simultaneously. The second rotating arm, however, is rotated at a faster speed than the first rotating arm during contact with the moving web causing the moving web to break in between the first and second contact surfaces.

In one embodiment, for instance, a perforation line can be formed into the moving web that is generally perpendicular to the direction of movement. The perforation line can be positioned in between the first and second contact surfaces of the rotating arms during the breaking process causing the web to break along the perforation line.

The conveying surface in one embodiment can comprise a rotating roll that rotates at generally the same speed as the web is moving. For instance, in one particular embodiment, the conveying surface may comprise a vacuum roll that not only rotates but holds the web onto the conveying surface.

During the breaking process, the first contact surface can be moving at generally about the same speed as the moving web during contact. The second contact surface, on the other hand, can be moving from about 2% to about 200% faster than the first contact surface. When the contacting surfaces are simultaneously contacting the moving web, the contacting surfaces can be spaced any suitable distance apart. For instance, in one embodiment, the contact surfaces may be from about 2 inches to about 12 inches apart, such as from about 4 inches to about 8 inches apart.

Yet another exemplary embodiment of the present invention includes a winder as substantially discussed above where each of the winding modules has a center winding means, a surface winding means, and a combination center and surface winding means.

DETAILED DESCRIPTION

Figure 1:
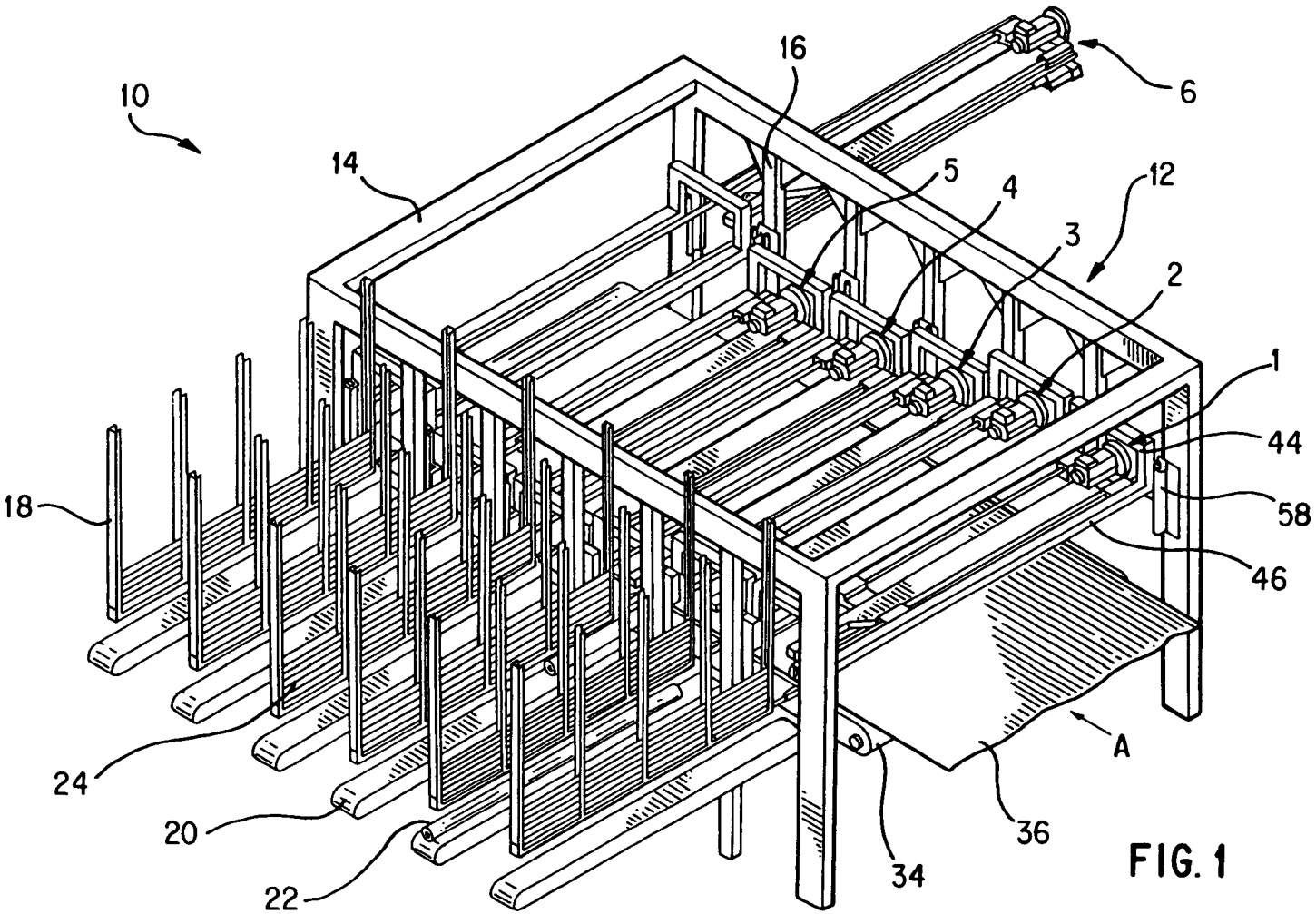
FIG. 1 is a perspective view of one exemplary embodiment of a winder of the present invention. This winder includes a plurality of independent winding modules that are positioned in the web direction with respect to one another and substantially contained within a modular frame.

Reference will now be made in detail to exemplary embodiments of the invention, one or more examples of which are illustrated in the drawings. Each example is provided by way of explanation of the invention, and not meant as a limitation of the invention. For example, features illustrated or described as part of one exemplary embodiment can be used with another exemplary embodiment to yield still a third exemplary embodiment. It is intended that the present invention include these and other modifications and variations.

A winder is provided in the present invention that is capable of winding web directly from a parent roll to form a rolled product. The winder may comprise a winding module that has a rotating mandrel that engages the leading edge of a moving web. Upon transfer of the leading edge of the web to the core, the winding mandrel is disengaged from the transport apparatus removing any nip pressure for the remainder of the wind. The web may be wound about the core through the rotation of the center driven mandrel. This type of winding is known as center winding. Additionally, the mandrel may be placed onto the web to form and maintain nip pressure between the winding mandrel and the web. The web may be wound about the core through the rotation of the surface driven mandrel. This type of winding is a form of surface winding. As such, the winding module of the present invention may wind web into a rolled product by center winding, surface winding, and combinations of center and surface winding. This allows for the production of rolled products with varying degrees of softness and hardness.

Also, the present invention provides for a winder that has a plurality of independent winding modules. Each individual winding module may wind the web such that if one or more modules are disabled, the remaining modules may continue to wind without interruption. This allows for operator servicing and routine maintenance or repairs of a module to be made without shutting down the winder. This configuration has particular advantages in that waste is eliminated and efficiency and speed of the production of the rolled product is improved.

The present invention makes use of a winding module 12 as shown in FIG. 1 in order to wind a web 36 and form a rolled product 22. Although a plurality of independent winding modules 12 may be used in the present invention to produce rolled products 22, the explanation of the functioning of only one winding module 12 is necessary in order to understand the building process of the rolled product 22.

Figure 5:
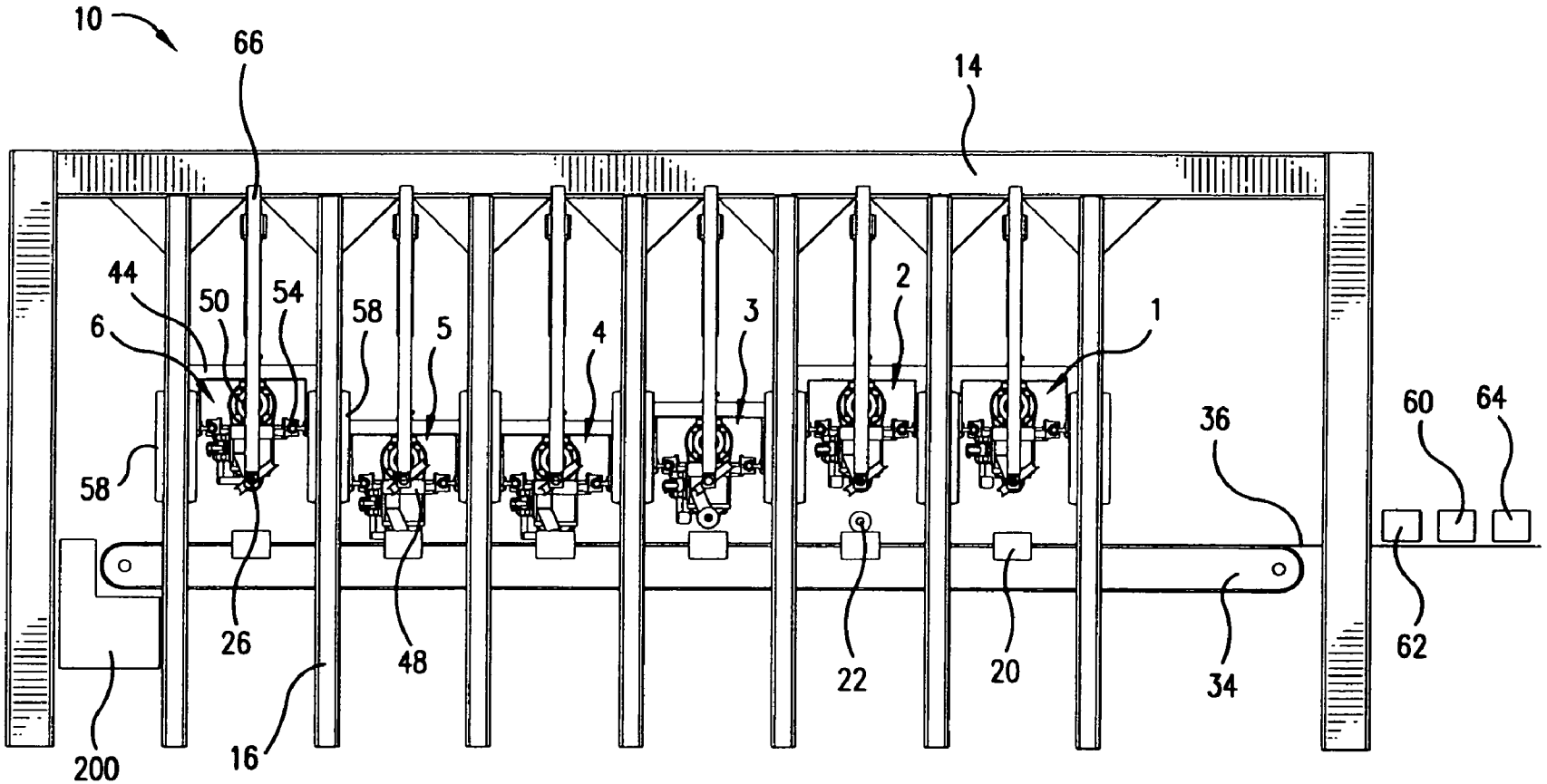
FIG. 5 is a side elevation view of an exemplary embodiment of a winder of the present invention. The drawing shows winding modules in addition to other modules, which perform functions on a web.
Figure 15:
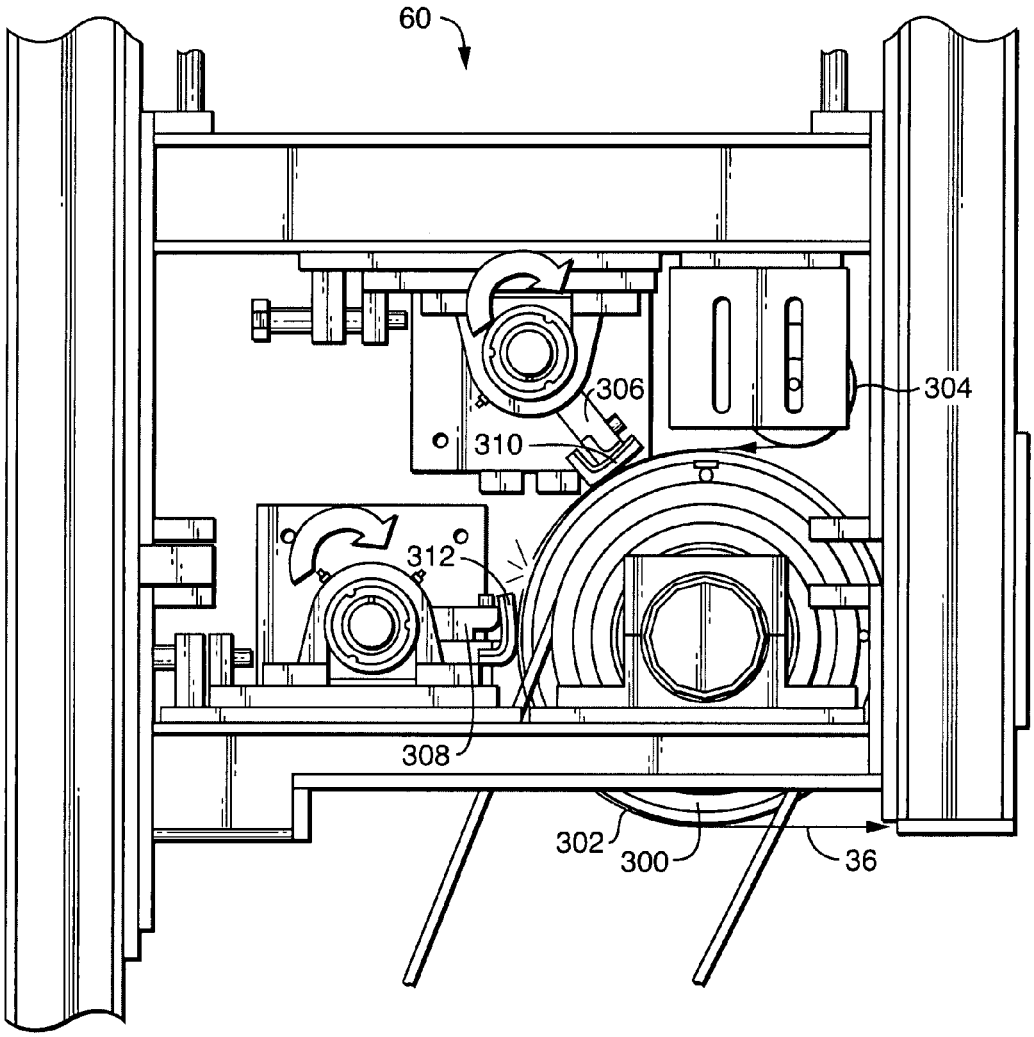
FIG. 15 is a side view of one embodiment of an apparatus for breaking a moving web.

Referring to FIG. 5, a web 36 is transported by a web transport apparatus 34 as shown. The web 36 is cut to a predetermined length by use of, for instance, a cut-off module 60 may be configured as a pinch bar as is disclosed in U.S. Pat. No. 6,056,229. However, any other suitable way to cut the web 36 to a desired length may be employed. For example, another embodiment of a cut-off module 60 made in accordance with the present disclosure is shown in FIG. 15 which will be described in more detail below. Additionally, the web 36 may be perforated by a perforation module 64 and have adhesive applied thereto by a transfer/tail seal adhesive applicator module 62 as also shown in FIG. 5. Additionally, in other exemplary embodiments, adhesion may be applied to the core 24 as opposed to the web 36. Referring back to FIG. 10, the mandrel 26 is accelerated so that the speed of the mandrel 26 matches the speed of the web 36. Mandrel 26 has a core 24 located thereon. The mandrel 26 is lowered into a ready to wind position and awaits the web 36. The core 24 is moved into contact with the leading edge of the web 36. The web 36 is then wound onto core 24 and is attached to core 24 by, for instance, the adhesive previously applied or and by the contact between the core 24 and the web 36.

Figure 11:
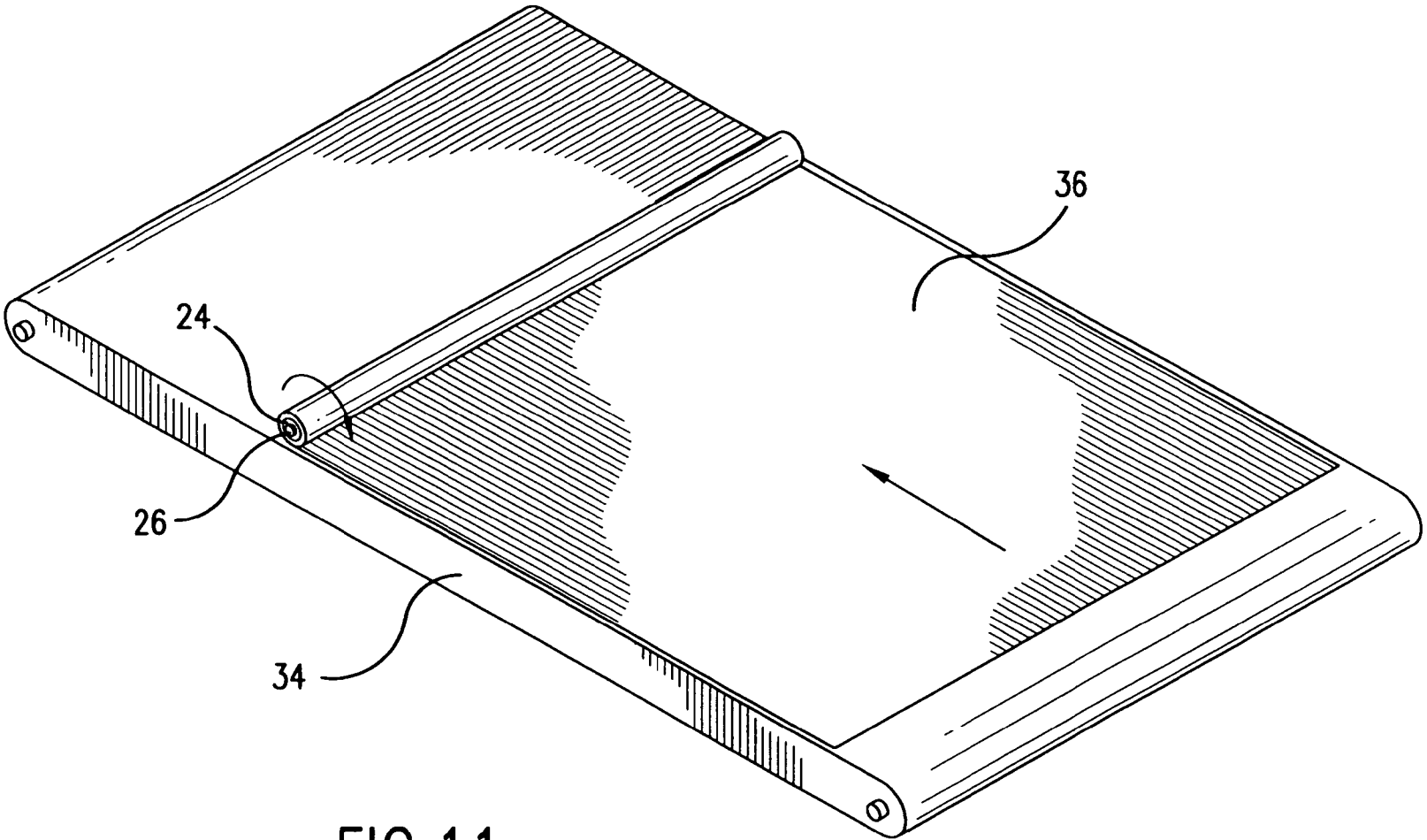
FIG. 11 is a perspective view of a rotating mandrel and core that are winding a web.

FIG. 11 shows the web 36 being wound onto the core 24. The winding of the web 36 onto core 24 may be controlled by the pressing of the core 24 onto the web transport apparatus 34 to form a nip. The magnitude with which the core 24 is pressed onto the web transport apparatus 34 creates a nip pressure that can control the winding of the web 36 onto the core 24. Additionally, the incoming tension of the web 36 can be controlled in order to effect the winding of the web 36 onto the core 24. Another control that is possible to wind the web 36 onto the core 24 involves the torque of the mandrel 26. Varying the torque on the mandrel 26 will cause a variance in the winding of the web 36 onto the core 24. All three of these types of winding controls, "nip, tension, and torque differential", can be employed in the present invention. Also, the winding of the web 36 may be affected by using simply one or two of these controls. The present invention therefore allows for any combination of winding controls to be employed in order to wind the web 36.

If not done before, the web 36 may be cut once the desired length of web 36 has been rolled onto the core 24. At this point, the leading edge of the next web 36 will be moved by the web transport apparatus 34 into contact with another winding module 12.

Figure 2:
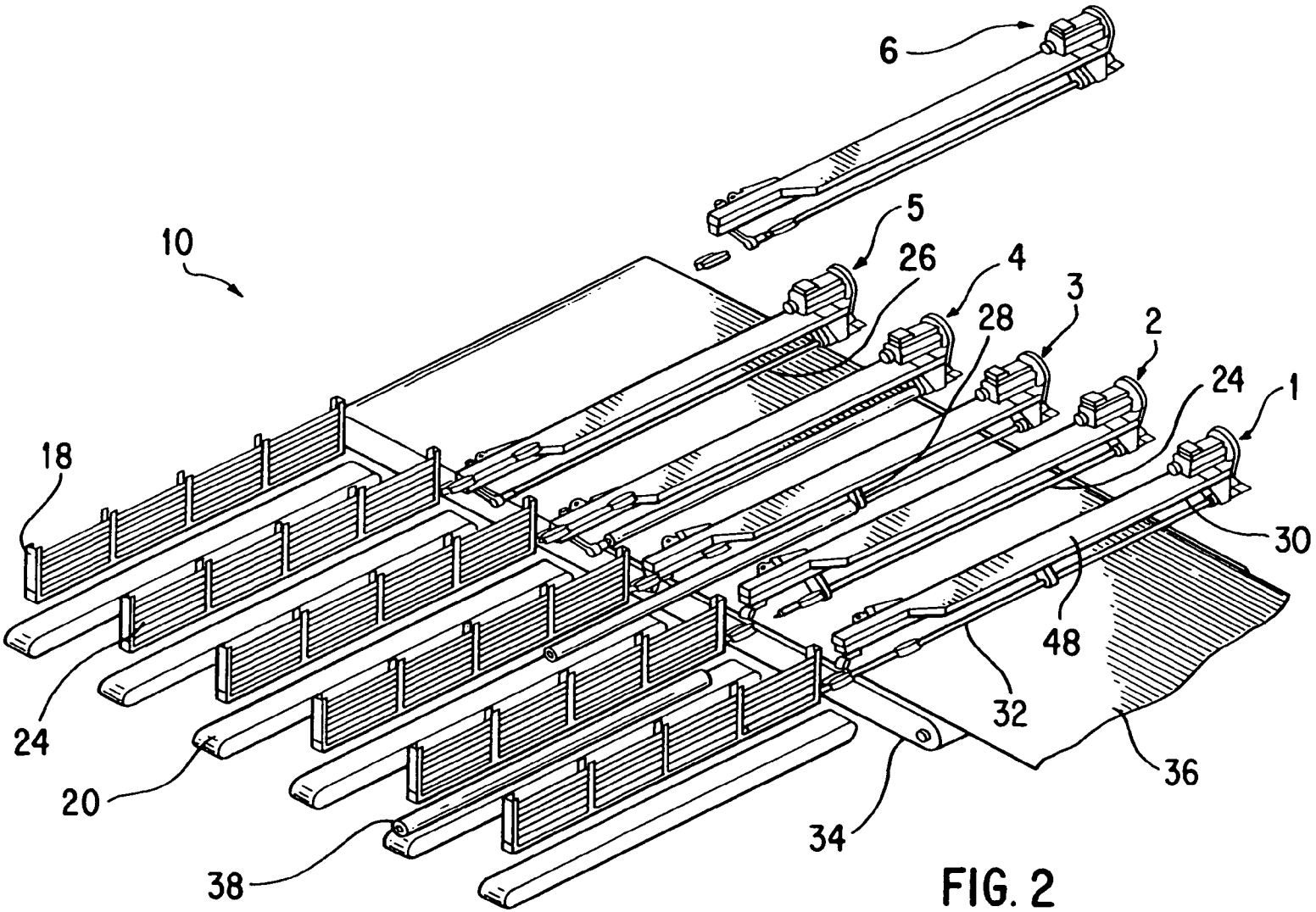
FIG. 2 is a perspective view of an exemplary embodiment of a winder of the present invention. This drawing shows a plurality of independent winding modules, which are performing the various functions of a log winding cycle.
Figure 10:
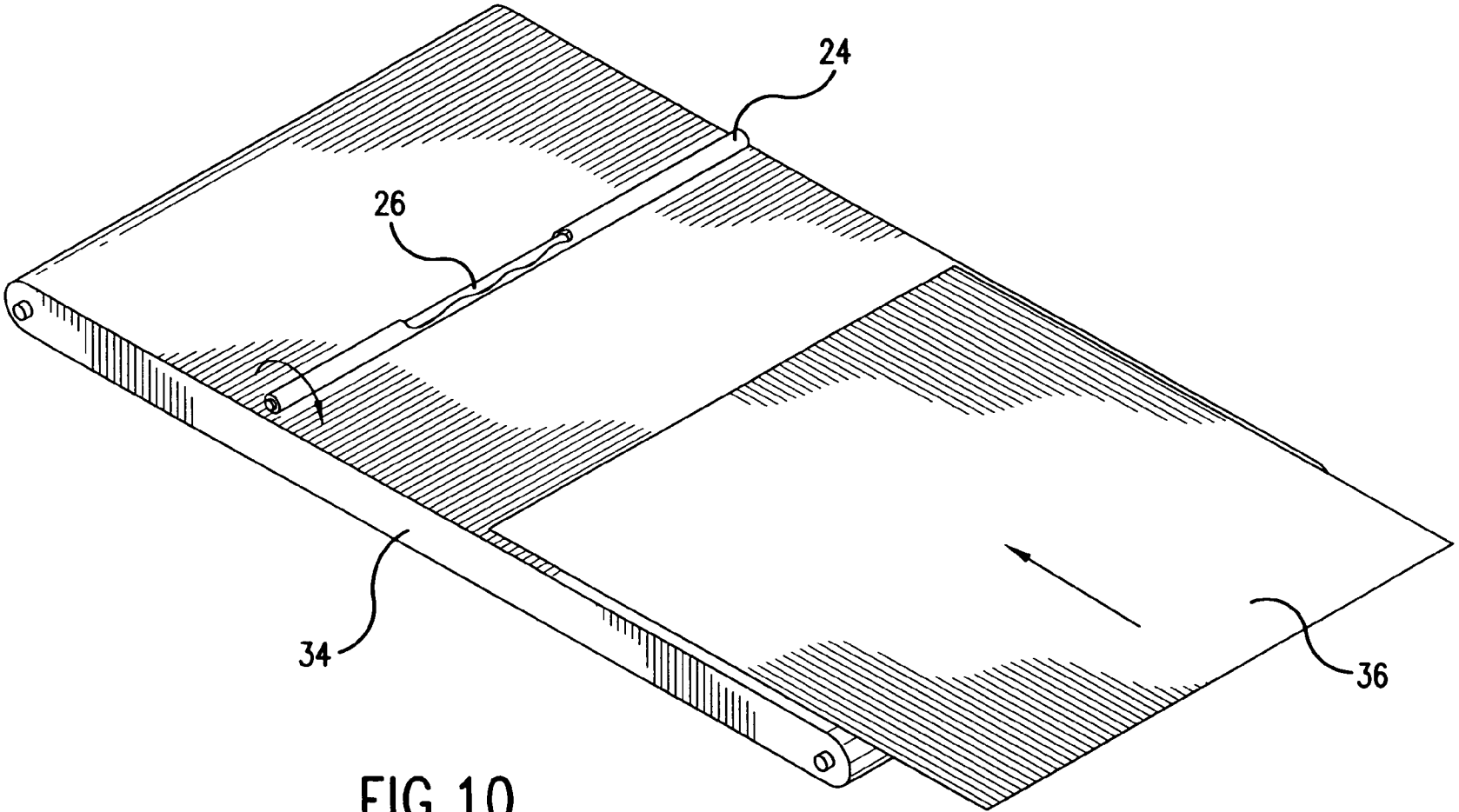
FIG. 10 is a perspective view of a web being transported by a web transport apparatus into proximity with a mandrel having a core.
Figure 12:
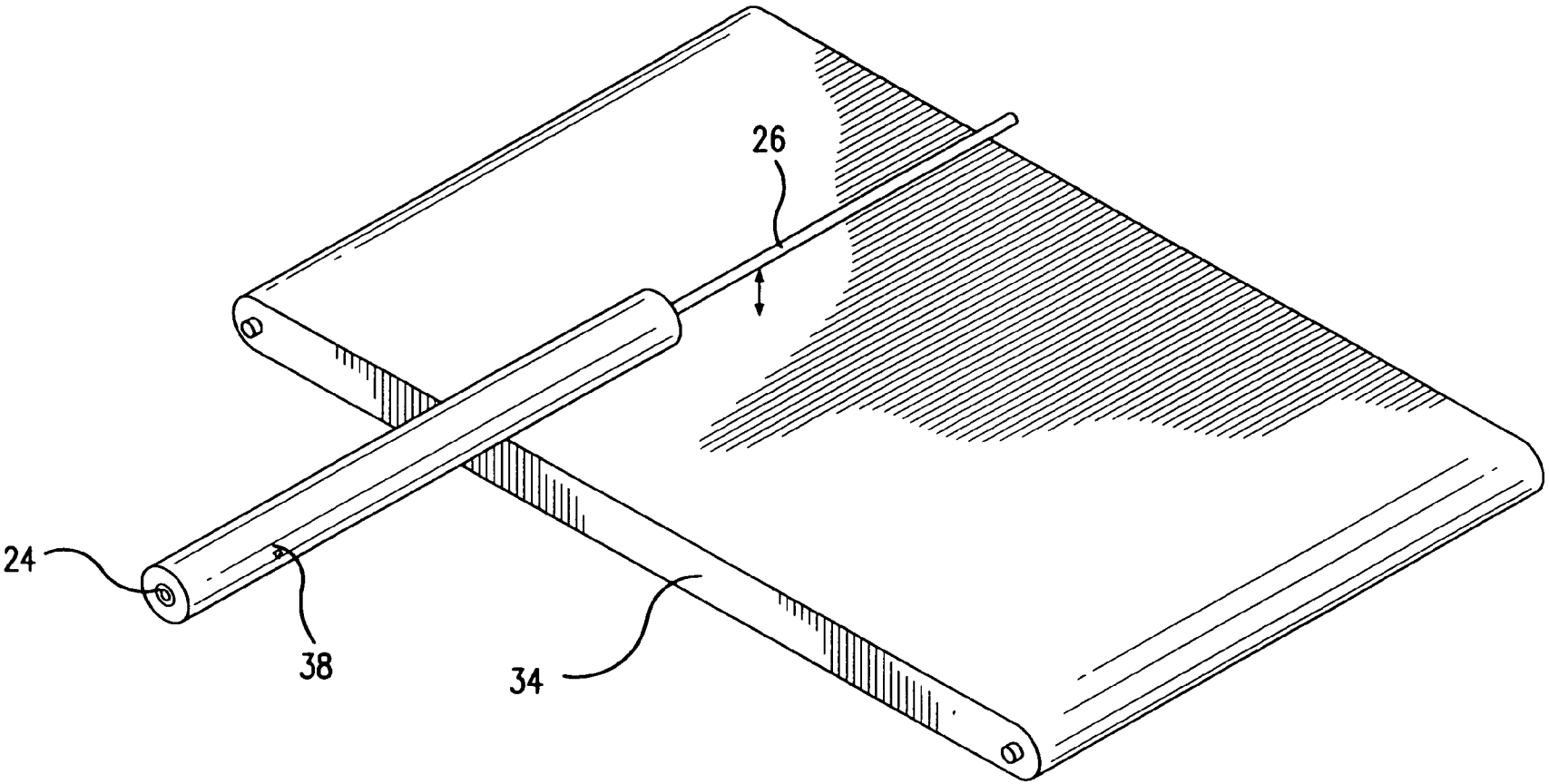
FIG. 12 is a perspective view of a rolled product with a core that is shown being stripped from a mandrel.

FIG. 12 shows the mandrel 26 being moved from a location immediately adjacent to the web transport apparatus 34 in FIG. 10 to a position slightly above the web transport apparatus 34. The wound length of web 36 is shown in FIG. 12 as being a rolled product 38 with a core 24. Now, a stripping function is carried out that moves the rolled product 38 with a core 24 off of the mandrel 26. This mechanism is shown as a product stripping apparatus 28 in FIG. 2. The rolled product 38 with a core 24 is moved onto a rolled product transport apparatus 20 as shown in FIGS. 1 and 2.

Figure 13:
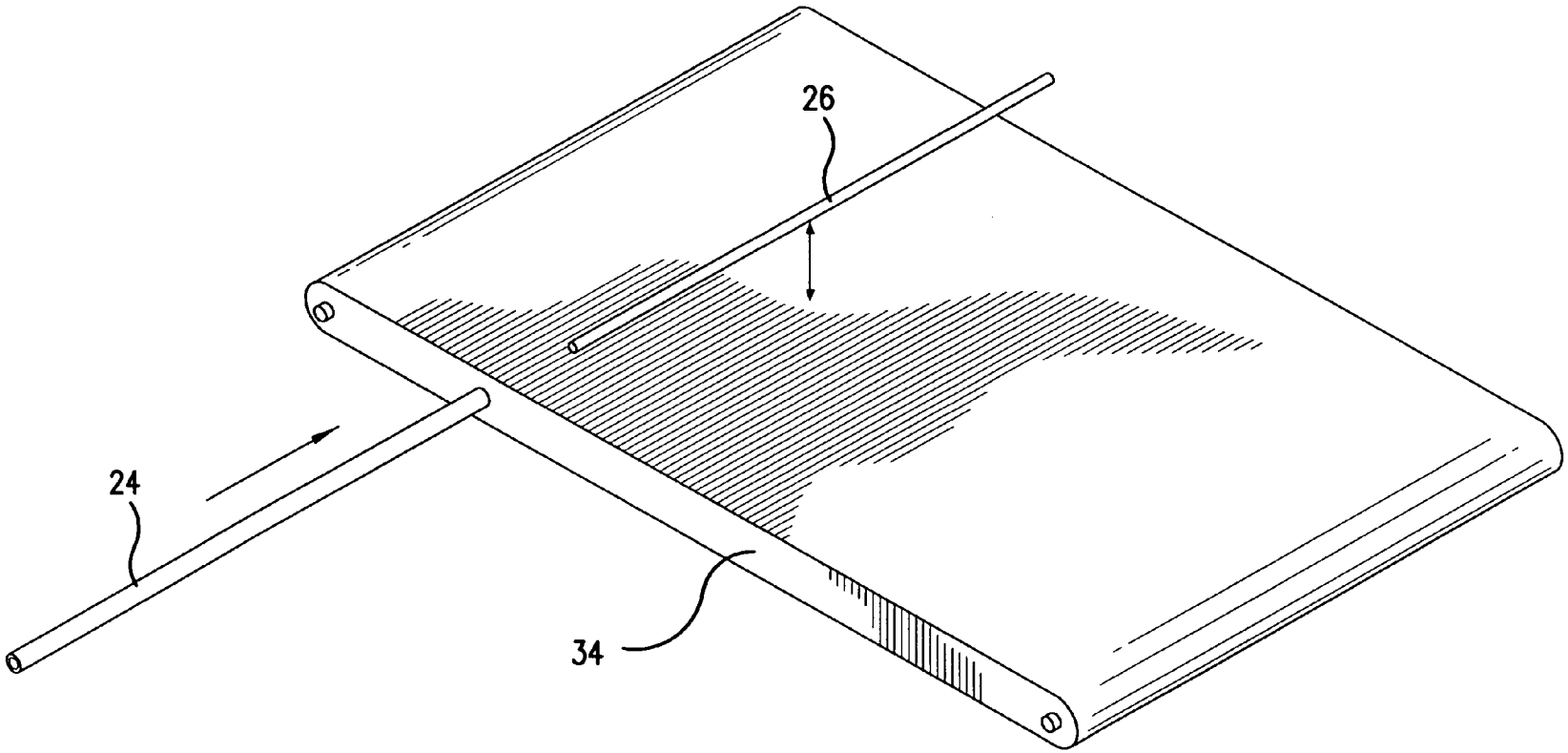
FIG. 13 is a perspective view of a mandrel that is in position to load a core.

Once the rolled product 38 with a core 24 is stripped from the mandrel 26, the mandrel 26 is moved into a core loading position as shown in FIG. 13. The product stripping apparatus 28 is shown in more detail in FIG. 2. Once the product stripping apparatus 28 finishes stripping the rolled product 38 with a core 24, the product stripping apparatus 28 is located at the end of the mandrel 26. This location acts to stabilize the mandrel 26 and prevent it from moving due to the cantilevered configuration of mandrel 26. In addition, the product stripping apparatus 28 helps to properly locate the end point of mandrel 26 for the loading of a core 24.

Figure 14:
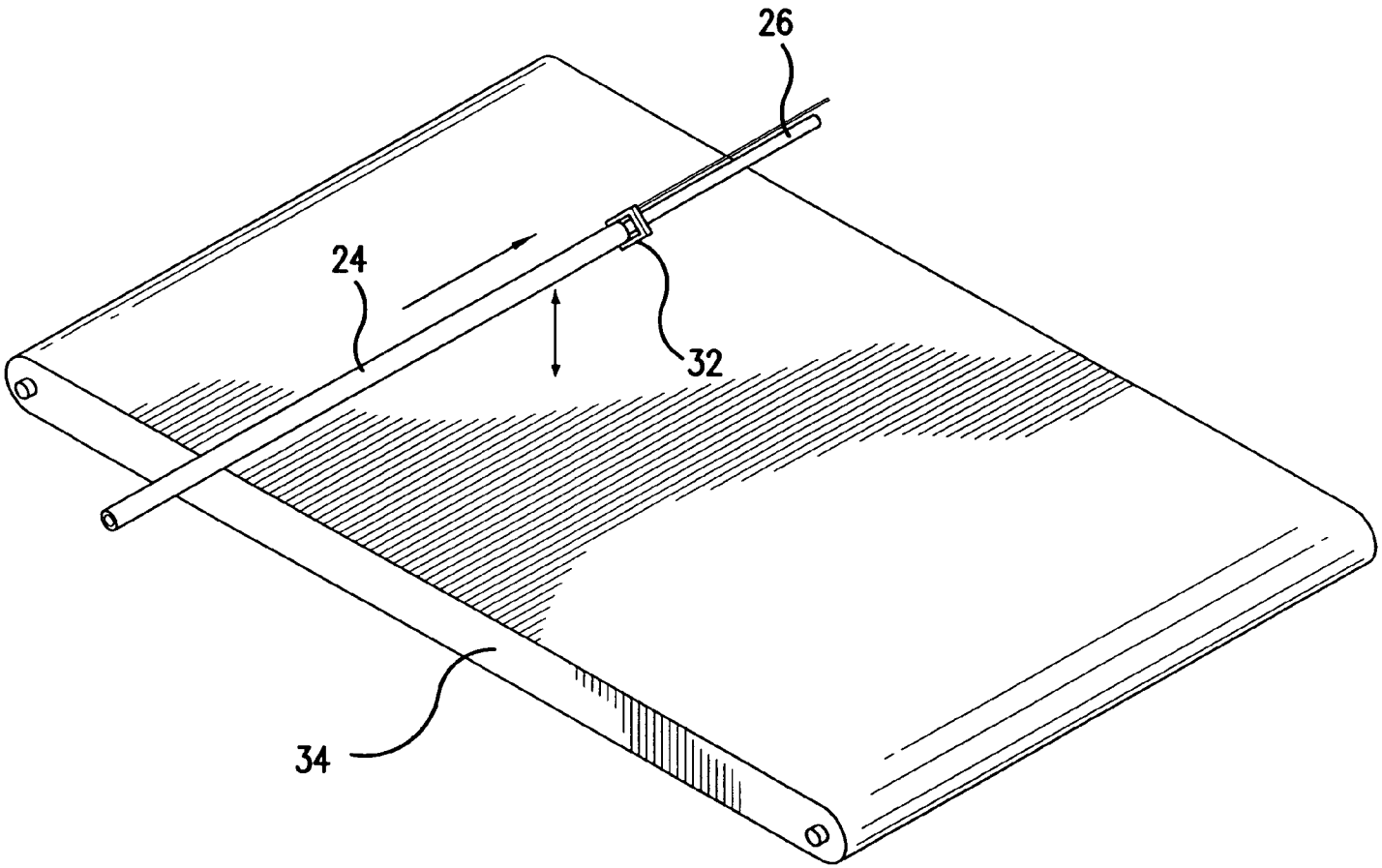
FIG. 14 is a perspective view that shows a core being loaded onto a mandrel via a core loading apparatus.

FIG. 14 shows one embodiment of a core 24 being loaded onto the mandrel 26. The loading of the core 24 is affected by a core loading apparatus 32. The product stripping apparatus may also serve as a core loading apparatus. The core loading apparatus 32 may be simply a frictional engagement between the core loading apparatus 32 and the core 24. However, the core loading apparatus 32 can be configured in other ways known in the art. For example, another embodiment of a core loading apparatus made in accordance with the present disclosure is shown in FIGS. 16-24 which will be described in more detail below. In one embodiment of the present invention, once the core 24 is loaded, a cupping arm 70 (shown in FIG. 6) closes. Upon loading of the core 24 onto the mandrel 26, the mandrel 26 is moved into the ready to wind position as shown in FIG. 10. The cores 24 are located in a core supplying apparatus 18 as shown in FIGS. 1, 2, 3, and 4.

FIG. 1 shows an exemplary embodiment of a winder according to the invention as a "rewinder" 10 with a plurality of independent winding modules 12 arranged in a linear fashion with respect to one another. A frame 14 supports the plurality of independent winding modules 12. A web transport apparatus 34 is present which transports the web 36 for eventual contact with the plurality of independent winding modules 12. The frame 14 is composed of a plurality of posts 16 onto which the plurality of independent winding modules 12 are slidably engaged and supported. The frame 14 may also be comprised of modular frame sections that would engage each other to form a rigid structure. The number of modular frame sections would coincide with number of winding modules utilized.

Situated adjacent to the frame 14 are a series of core supplying apparatuses 18. A plurality of cores 24 may be included within each core supplying apparatus 18. These cores 24 may be used by the plurality of independent winding modules 12 to form rolled products 22. Once formed, the rolled products 22 may be removed from the plurality of independent winding modules 12 and placed onto a rolled product transport apparatus 20. The rolled product transport apparatus 20 is located proximate to the frame 14 and web transport apparatus 34.

FIG. 2 shows a rewinder 10 as substantially disclosed in FIG. 1 but having the frame 14 and other parts removed for clarity. In this exemplary embodiment, the plurality of independent winding modules 12 are composed of six winding modules 1-6. However, it is to be understood that the present invention includes exemplary embodiments having any number of independent winding modules 12 being other than six in number, for instance only one winding module 12 may be used in another exemplary embodiment.

Each winding module 1-6 is shown performing a different function. Winding module 1 is shown in the process of loading a core 24 thereon. The plurality of independent winding modules 12 are provided with a core loading apparatus for placing a core 24 onto a mandrel 26 of the plurality of independent winding modules 12. Any number of variations of a core loading apparatus may be utilized in other exemplary embodiments of the present invention. For instance, the core loading apparatus may be a combination of a rod that extends into the core supplying apparatus 18 and pushes a core 24 partially onto the mandrel 26 and a mechanism attached to the linear actuator of the product stripping apparatus 28 that frictionally engages and pulls the core 24 the remaining distance onto the mandrel 26. As shown in FIG. 2, winding module 1 is in the process of pulling a core 24 from the core supplying apparatus 18 and placing the core 24 on mandrel 26.

Referring to FIGS. 16-24, one embodiment of a core loading apparatus that may be used in accordance with the present disclosure is shown. In particular, FIGS. 16-23 illustrate a sequence of loading a core 24 onto a mandrel 26 in order to form a rolled product 22 which is then stripped off the mandrel 26.

Figure 16:
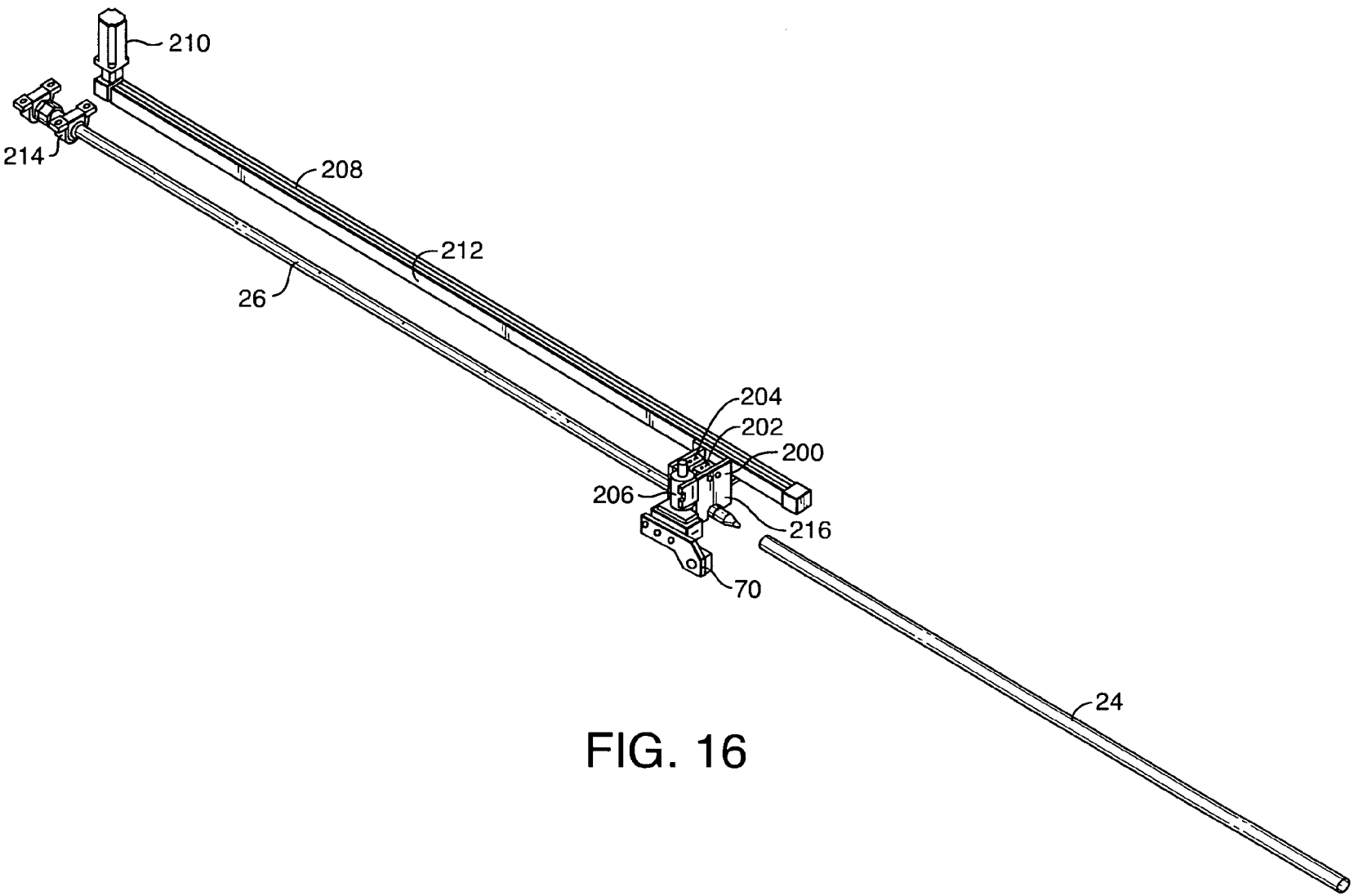
FIGS. 16 through 23 are perspective views of an alternative embodiment of a core loading apparatus showing sequentially a core being loaded onto a mandrel and then being stripped from the mandrel.

As shown in FIG. 16, the core loading apparatus includes a core loading assembly 200 that slides back and forth across the mandrel 26. The core loading assembly 200 includes a gripping device 202 for engaging the core 24 and optionally a stabilizer 204. The core loading assembly 200 is attached to an actuator 208, such as a linear actuator as shown. In particular, the core loading assembly 200 is mounted to the linear actuator which is positioned parallel to the mandrel 26. The actuator 208 includes a motor 210 that drives a track 212. The track 212 is attached to the core loading assembly 200 such that the core loading assembly traverses back and forth across the mandrel 26 as the motor 206 drives the track 212. The track 212 may comprise, for instance, a belt as shown or can be a chain or any other suitable device.

In addition to the linear actuator 208 as shown in FIG. 16, it should be understood that any suitable actuator may be used that is capable of moving the core loading assembly 200 along the mandrel 26. For example, in other embodiments, a pneumatic or hydraulic actuator may be used. Alternatively, a ball screw or the like may be used as the actuator.

The mandrel 26 as shown is supported on one end by a bearing 214. On the opposite end, the mandrel 26 is engagable with a cupping arm 70. The cupping arm 70 is in communication with a motor 206. The motor 206 causes the cupping arm to rotate thereby engaging and disengaging the end of the mandrel 26. For example, in FIG. 20, the cupping arm 70 is shown in the engaged position for supporting the end of the mandrel 26. The cupping arm 70 is used to engage and support the end of the mandrel 26 during winding. When loading the core 24 or when stripping a rolled product from the mandrel 26, on the other hand, the cupping arm 70 disengages the mandrel 26. When the cupping arm 70 is disengaged from the mandrel 26, the stabilizer 204 of the core loading assembly engages the mandrel for supporting the mandrel while a core is being loaded.

Figure 18:
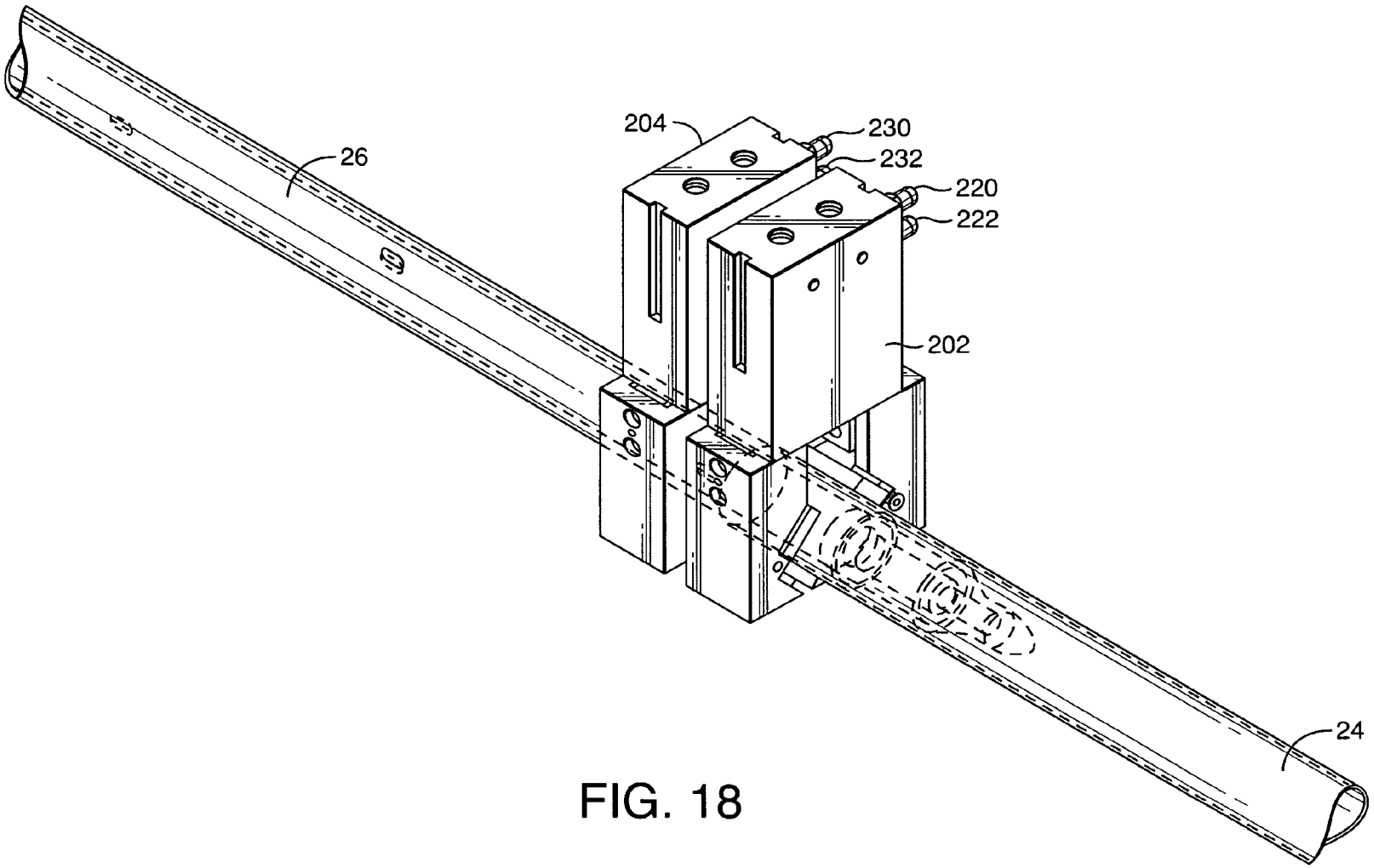
Figure 24:
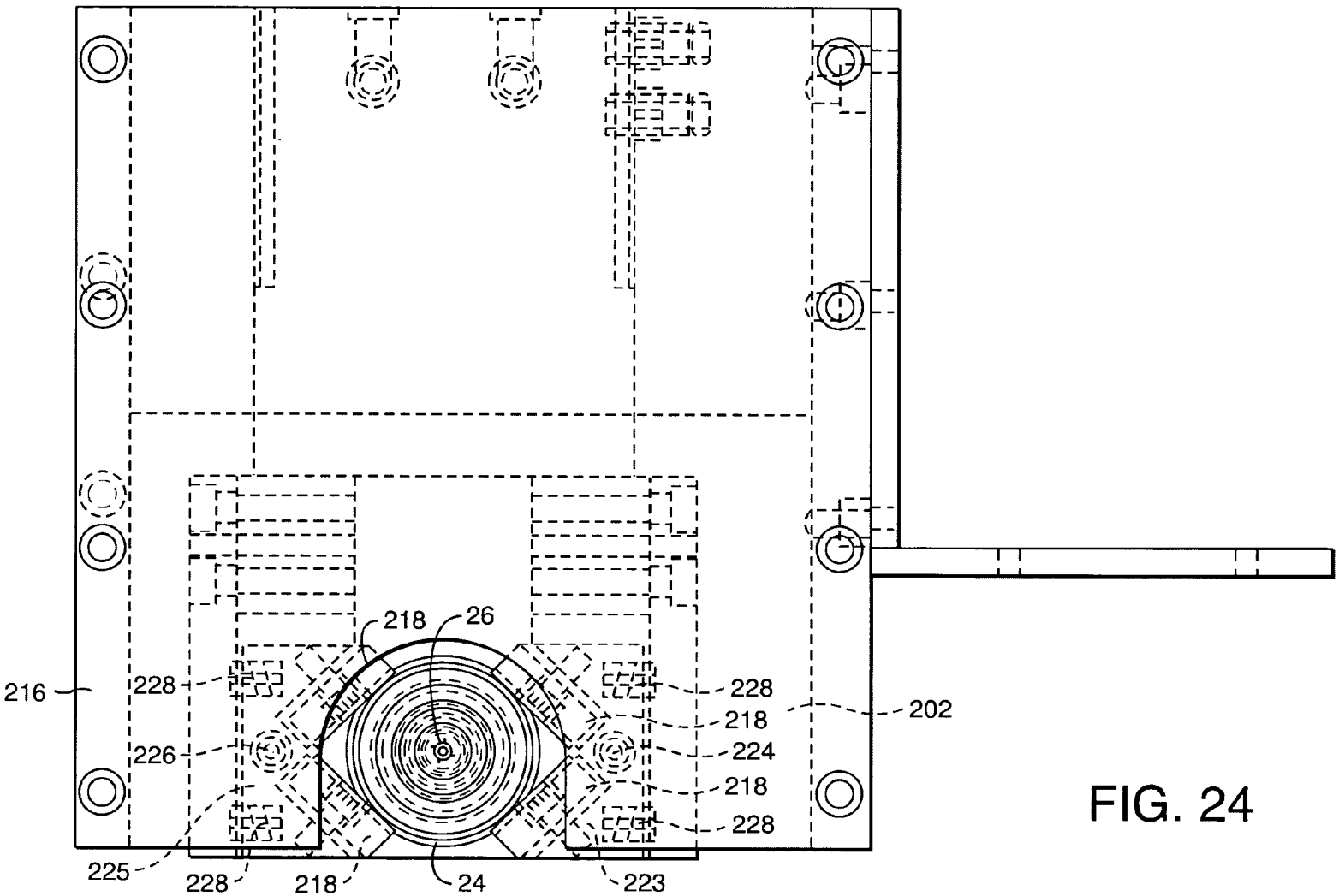
FIG. 24 is a side view of the core loading assembly illustrated in FIGS. 16 through 23.

As illustrated in FIG. 16, the gripping device 202 and the stabilizer 204 are contained within a housing 216 to form the core loading assembly 200. An enlarged view of the gripping device 202 and the stabilizer 204 with the housing removed is shown in FIG. 18. A cross-sectional view of the gripping device 202 is also illustrated in FIG. 24. As shown in FIG. 24, the gripping device 202 includes gripping members 218 that are intended to surround and grip the core 24. In the embodiment illustrated in FIG. 24, four gripping members 218 are shown. It should be understood, however, that a greater or lesser number of gripping members may be utilized. The gripping members are movable towards and away from each other for gripping and releasing the core 24.

For example, in one embodiment, the gripping members 218 can be pneumatically or hydraulically actuated. In this regard, as shown in FIG. 18, the gripping device 202 includes a fluid inlet 220 and a fluid outlet 222. The fluid inlet 220 and the fluid outlet 222 are for flowing a fluid into and out of the gripping device 202 for respectively moving the gripping members 218 towards and away from each other.

In the embodiment illustrated in FIG. 24, the gripping members 218 generally form a rectangular-like cross-sectional shape for engaging the core 24. It should be understood, however, that any suitable cross-sectional shape capable of surrounding the core 24 for engaging the core can be utilized. For example, in an alternative embodiment, the gripping device 202 may only include two gripping members that have an arc-like shape.

The gripping members 218 of the gripping device 202 are intended to engage and hold the core 24 for pulling the core onto the mandrel 26 without damaging the core. For example, having the gripping members 218 be fluid controlled allows for fine adjustments in the amount of pressure being placed on the core 24. In addition, the gripping members 218 can pivot which allows for the gripping members to accommodate for some misalignment.

For instance, as shown in FIG. 24, the gripping device 202 includes a first pivot member 223 defining a first pivot point 224 and a second pivot member 225 defining a second pivot point 226. In addition, the gripping device 202 includes four springs 228. More particularly, the pivot point 224 is surrounded by an upper and lower spring 228, while the pivot point 226 is also surrounded by an upper and lower spring 228. The pivot points and the springs allow the pivot members 223 and 225 and thus the gripping members 218 some flexibility in movement. More particularly, the right pair of gripping members 218 can pivot about the pivot point 224 while the left pair of gripping members 218 can pivot about the pivot point 226. In this manner, when the core 24 is engaged by the gripping members, not only can the gripping members move back and forth but can also pivot for pulling the core onto the mandrel without misalignment and without damaging the core.

The gripping members 218 can be made from any suitable material capable of engaging the core 24 without damaging the core. The gripping members 218, for instance, can be made for any suitable hard or soft material. In one particular embodiment, for instance, the gripping members 218 can be made from a metal.

As shown in FIG. 18, the core loading assembly 200 also includes the stabilizer 204. The stabilizer 204 can be included in the assembly in order to stabilize the mandrel as the core is being loaded onto the mandrel. In one embodiment, as shown in FIG. 18, the stabilizer 204 can generally have the same construction as the gripping device 202. For instance, the stabilizer 204 can include at least two stabilizing members that slidably engage the mandrel 26 and move towards and away from each other by flowing a fluid through a fluid inlet 230 and a fluid outlet 232. In one embodiment, the stabilizer 204 can include four stabilizing members having the same exact configuration as the gripping members 218. The stabilizing members, however, are for slidably engaging the mandrel 26. In this regard, the stabilizing members can have a low friction surface made from a lubricating material, such as a polyolefin. The stabilizing members, for instance, can include a polyethylene or a polypropylene surface that slides among the mandrel 26 as the core 24 is loaded.

The core loading assembly 200 and the actuator 208 can be placed in communication with a controller, such as a microprocessor that is capable of actuating a sequence for loading a core onto the mandrel at a desired position and then stripping a rolled product from the mandrel. One sequence for loading a core onto the mandrel is illustrated in FIGS. 16-23.

For instance, as shown in FIG. 16, in order to load the core 24 onto the mandrel 26, the cupping arm 70 is first disengaged from the mandrel 26 and the core loading assembly 200 is positioned at the open end of the mandrel 26. In this manner, not only is the core loading assembly 200 at a position for engaging the core 24 but also stabilizes the mandrel 26 when the cupping arm 70 is disengaged.

Figure 17:
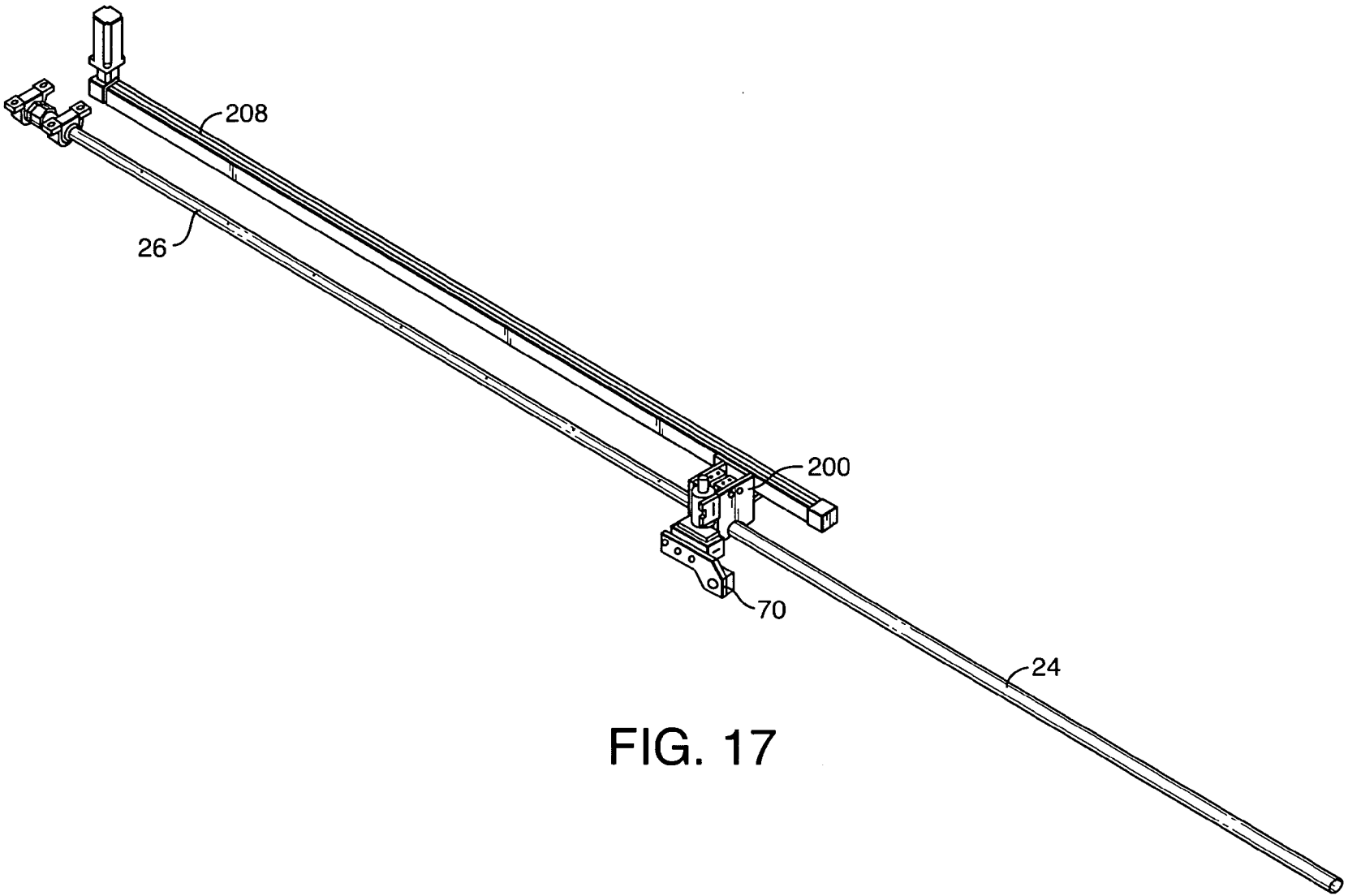

As shown in FIGS. 17 and 18, the gripping device 202 surrounds an outer circumference of the core 24 for engaging the core. The core can be supplied to the gripping device from a core supplying apparatus.

Figure 19:
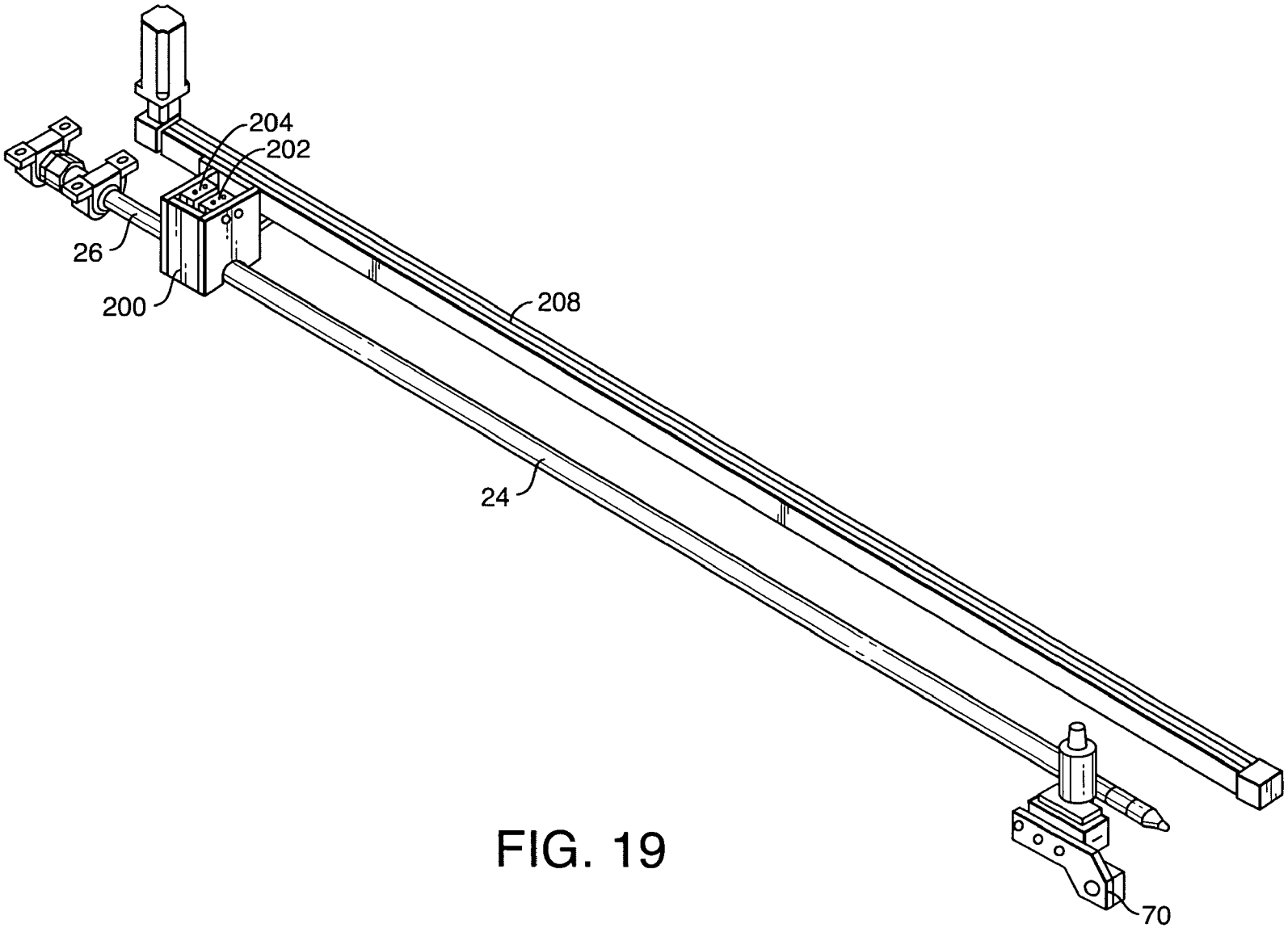
Figure 20:
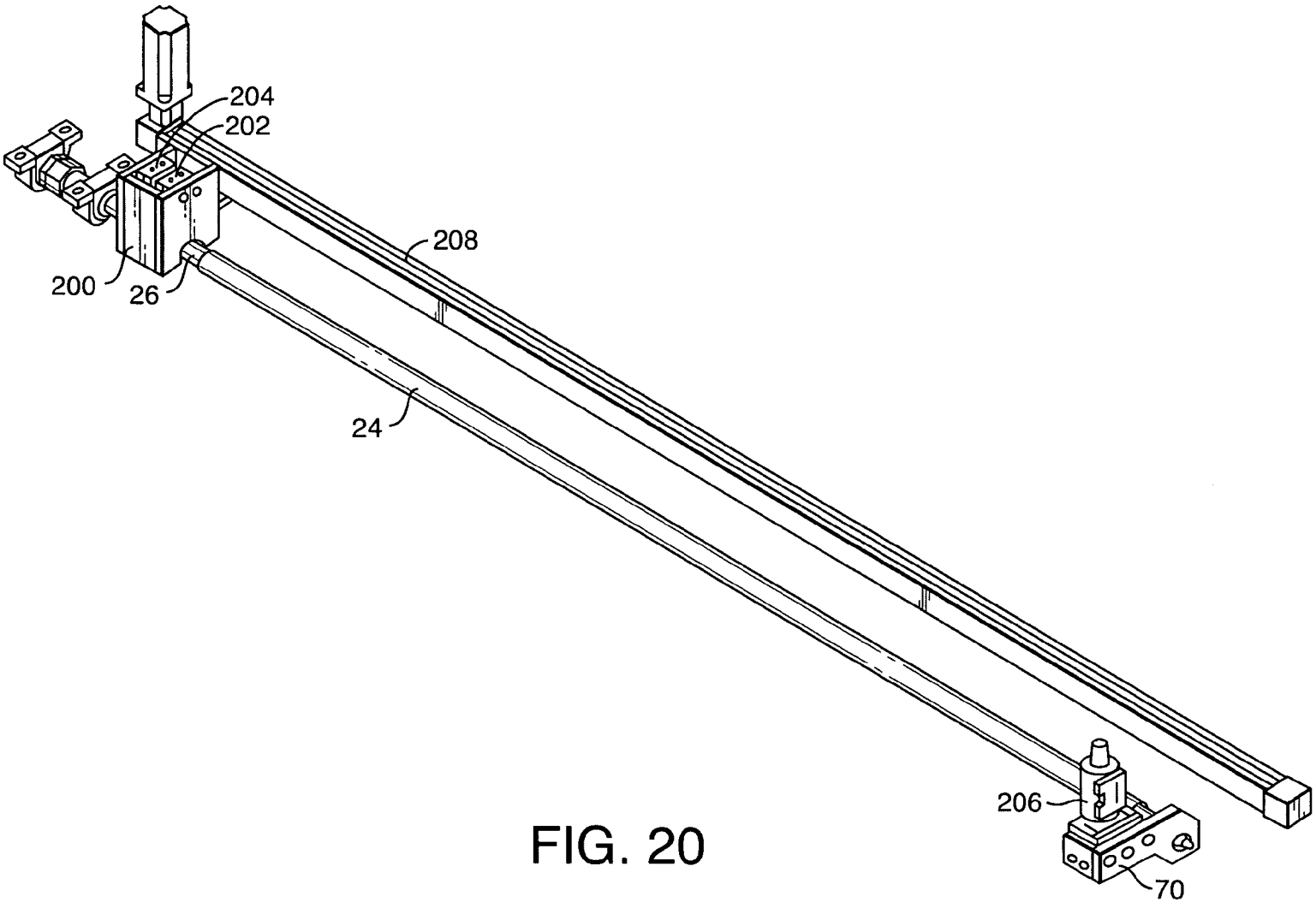

Once the core is engaged, the core 24 is pulled onto the mandrel 26 as shown in FIG. 19 using the actuator 208. The actuator 208 can be configured to place the core 24 at a particular position on the mandrel 26. Once the core 24 is positioned into a particular position, the gripping device 202 can release the core as shown in FIG. 20. The core loading assembly 200 is then moved further to the end of the mandrel to prevent interference with the core 24 as a web of material is wound onto the core. Also, as shown in FIG. 20, the cupping arm 70 is moved back into engagement with the mandrel 26.

Figure 21:
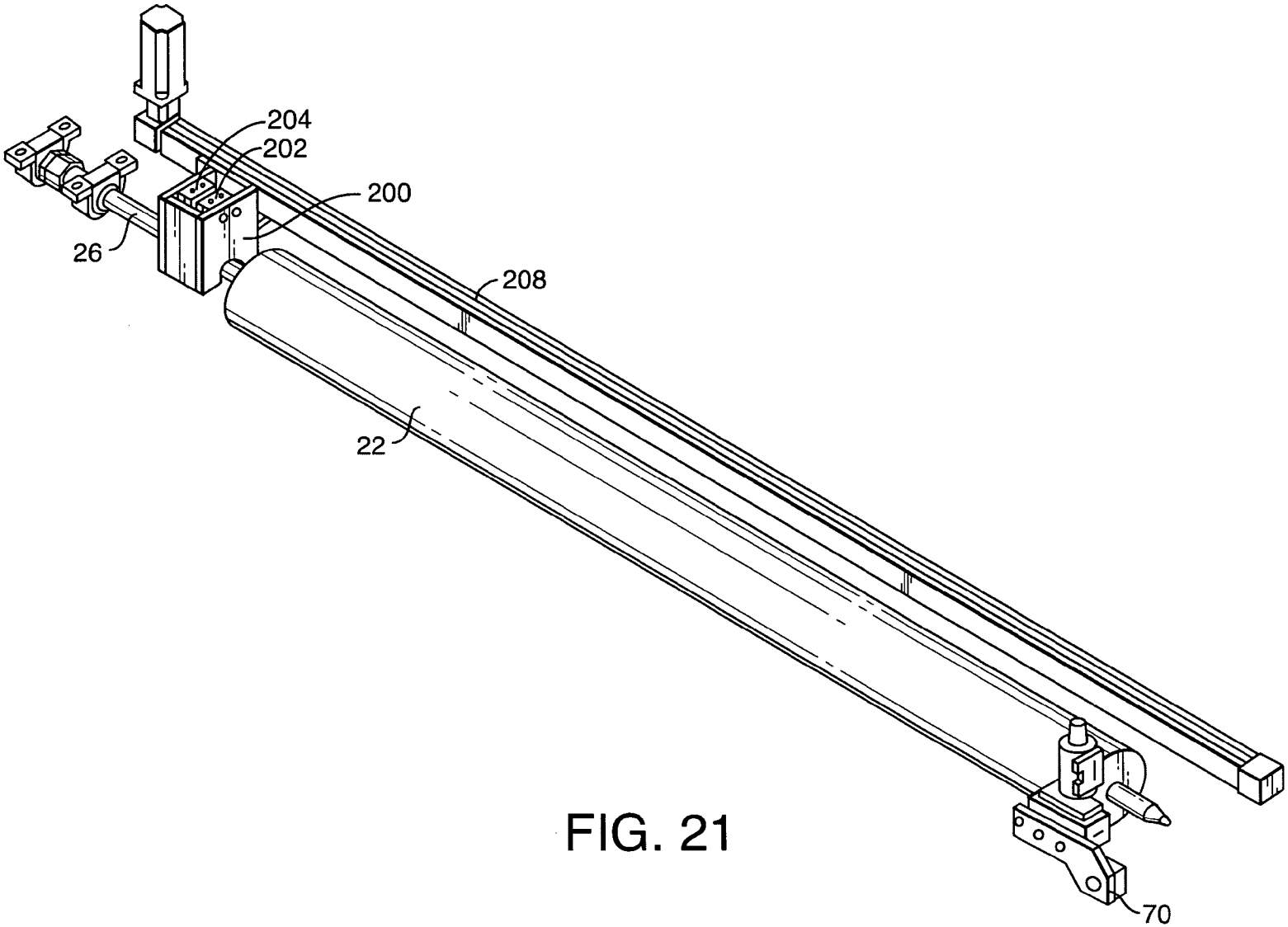
Figure 22:
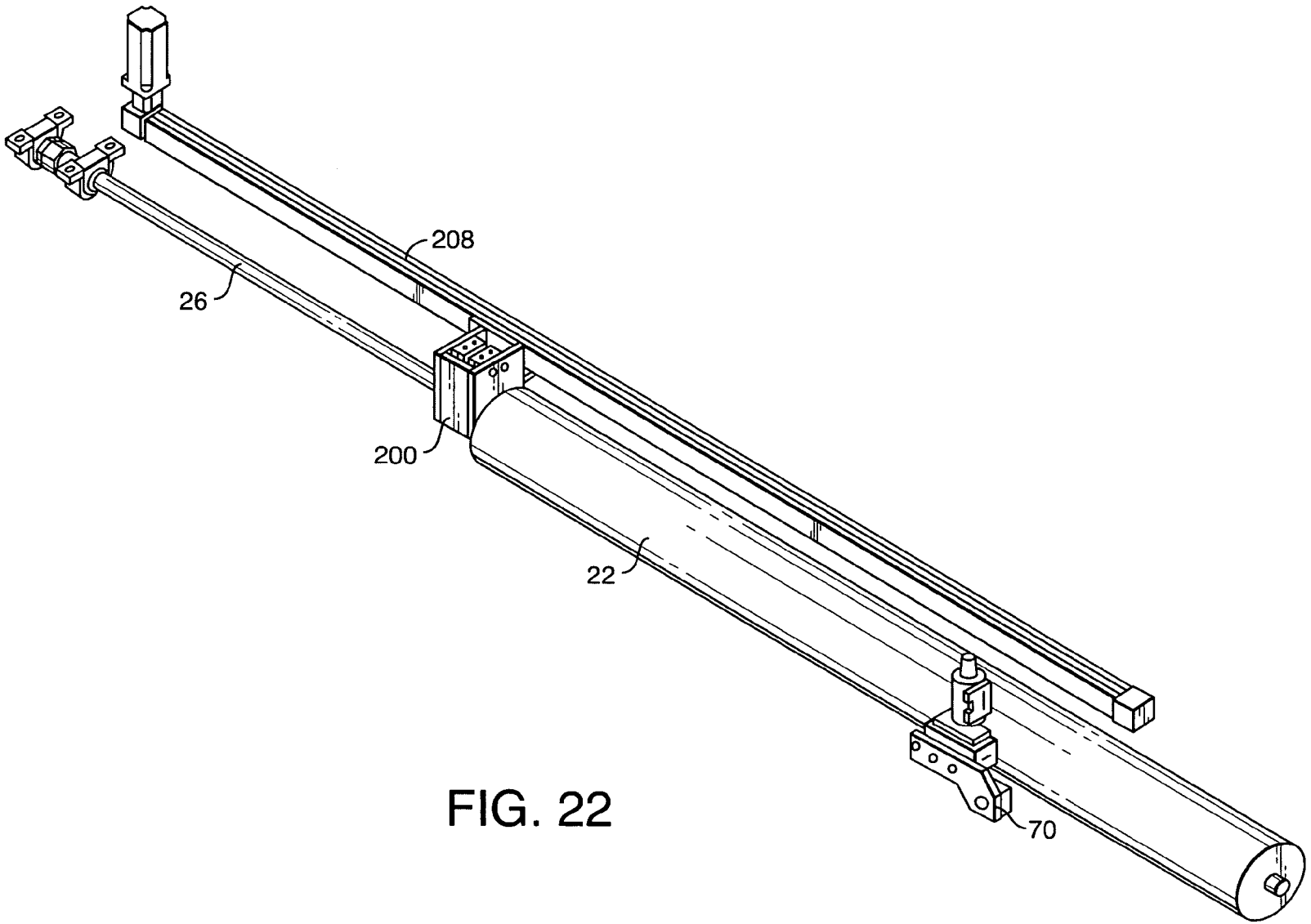
Figure 23:
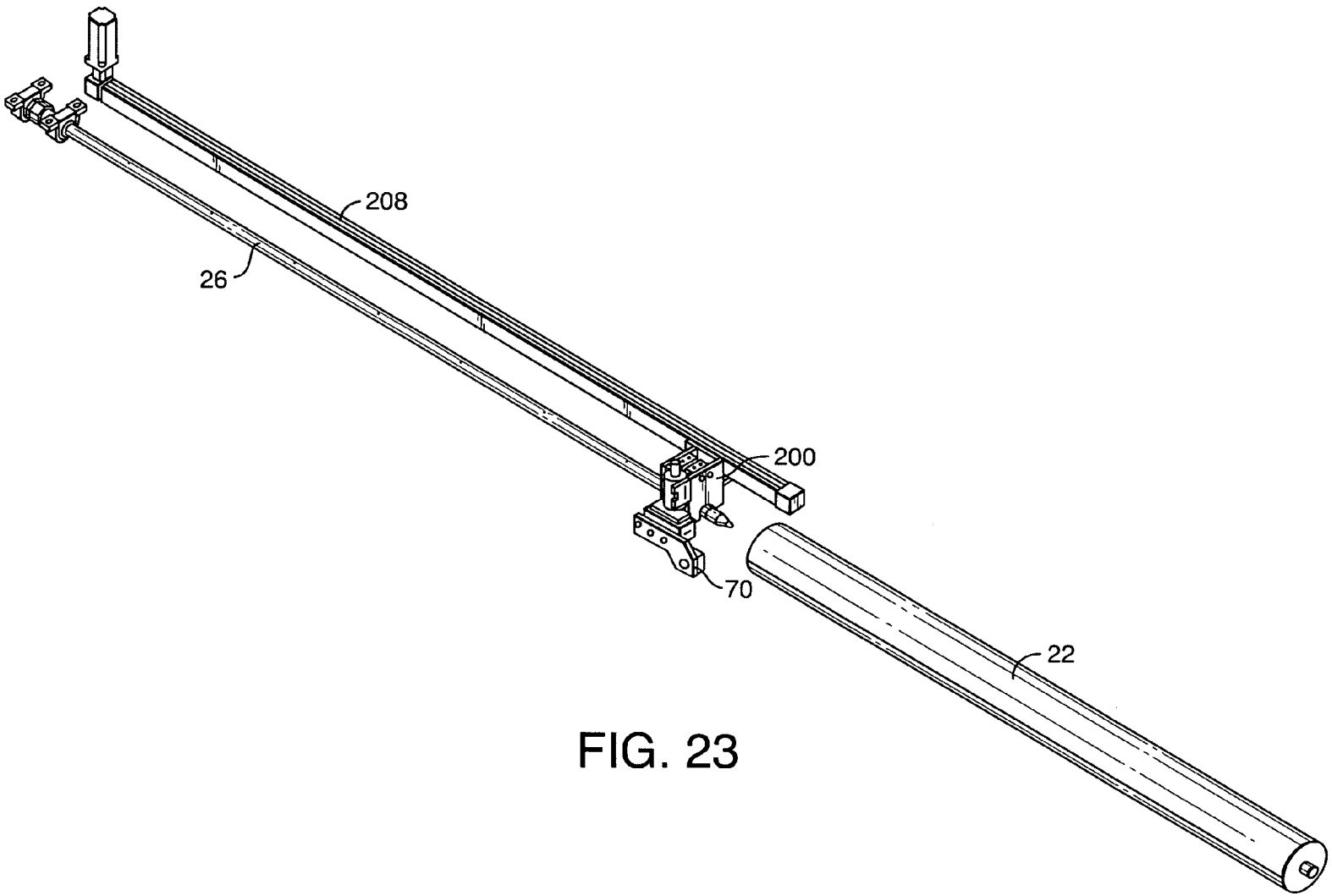

Once the core 24 is loaded onto the mandrel 26 as shown in FIG. 20, a rolled product 22 is formed on the mandrel as shown in FIG. 21. Of particular advantage, in this embodiment, the core loading assembly 200 can also be used to strip the rolled product 22 from the mandrel 26. For instance, as shown in FIG. 22, once the rolled product 22 is formed, the actuator 208 can move the core loading assembly 200 into engagement with the rolled product for sliding the rolled product off the mandrel 26 as shown in FIG. 23. The rolled product 22 once stripped from the mandrel 26 can then be fed to a rolled product transfer apparatus. Of particular advantage, the core loading assembly 200 stabilizes the mandrel as it pushes the rolled product off of the mandrel. In particular, the core loading assembly 200 holds the open free end of the mandrel which reduces the whip of the mandrel and therefore prevents against misalignments. Further, once the rolled product is stripped from the mandrel, the core loading assembly 200 is in a position for engaging and pulling a new core onto the mandrel.

The core loading apparatus described above can provide various benefits and advantages when forming the rolled products. For example, the core loading apparatus as described above is capable of pulling the cores onto the mandrel into a fixed position. In addition, the mandrel is stabilized and held in position during the loading process. By minimizing positional changes of the core and of the mandrel, the likelihood of successful core loading is vastly improved, which maximizes productivity and minimizes waste with respect to core loading operations. Furthermore, the core loading apparatus as described above is conducive to various conditions of core material and rigidity. For example, limp or flaccid cores can be pulled onto mandrels instead of rigid paper material if desired. In addition, the core loading apparatus also serves as a log strip device after the rolled product is formed. This dual function is advantageous because it simplifies design and minimizes hardware.

Referring back to FIG. 2, winding module 2 is shown as having removed the rolled product 22 from its mandrel 26. The rolled product 22 is placed onto a rolled product transport apparatus 20. In this case, the rolled product 22 is a rolled product with a core 38. Such a rolled product with a core 38 is a rolled product 22 that is formed by having the web 36 being spirally wrapped around a core 24. It is to be understood that the rolled product 22 may also be a rolled product that does not have a core 24 and instead is simply a solid roll of wound web 36. It may also be the case that the rolled product 22 formed by the present invention does not include a core 24, but has a cavity in the center of the rolled product 22. Various configurations of rolled product 22 may thus be formed in accordance with the present invention.

Each of the plurality of independent winding modules 12 is provided with a product stripping apparatus 28 that is used to remove the rolled product 22 from the winding modules 1-6. Winding module 3 is shown as being in the process of stripping a rolled product 22 from the winding module 3. The product stripping apparatus 28 is shown as being a flange which stabilizes the mandrel 26 and contacts an end of the rolled product 22 and pushes the rolled product 22 off of the mandrel 26. Also, the product stripping apparatus 28 helps locate the end of the mandrel 26 in the proper position for the loading of a core 24. The rolled product stripping apparatus 28 therefore is a mechanical apparatus that moves in the direction of the rolled product transport apparatus 20. The product stripping apparatus 28 may be configured differently in other exemplary embodiments of the invention.

The winding module 4 is shown as being in the process of winding the web 36 in order to form the rolled product 22. This winding process may be center winding, surface winding, or a combination of center and surface winding. These processes will be explained in greater detail below.

Winding module 5 is shown in a position where it is ready to wind the web 36 once the winding module 4 finishes winding the web 36 to produce a rolled product 22. In other words, winding module 5 is in a "ready to wind" position.

Winding module 6 is shown in FIG. 1 in a "racked out" position. It may be the case that winding module 6 has either faulted or is in need of routine maintenance and is therefore moved substantially out of frame 14 for access by maintenance or operations personnel. As such, winding module 6 is not in a position to wind the web 36 to produce rolled product 22, but the other five winding modules 1-5 are still able to function without interruption to produce the rolled product 22. By acting as individual winders, the plurality of independent winding modules 12 allow for uninterrupted production even when one or more of the winding modules becomes disabled.

Figure 4:
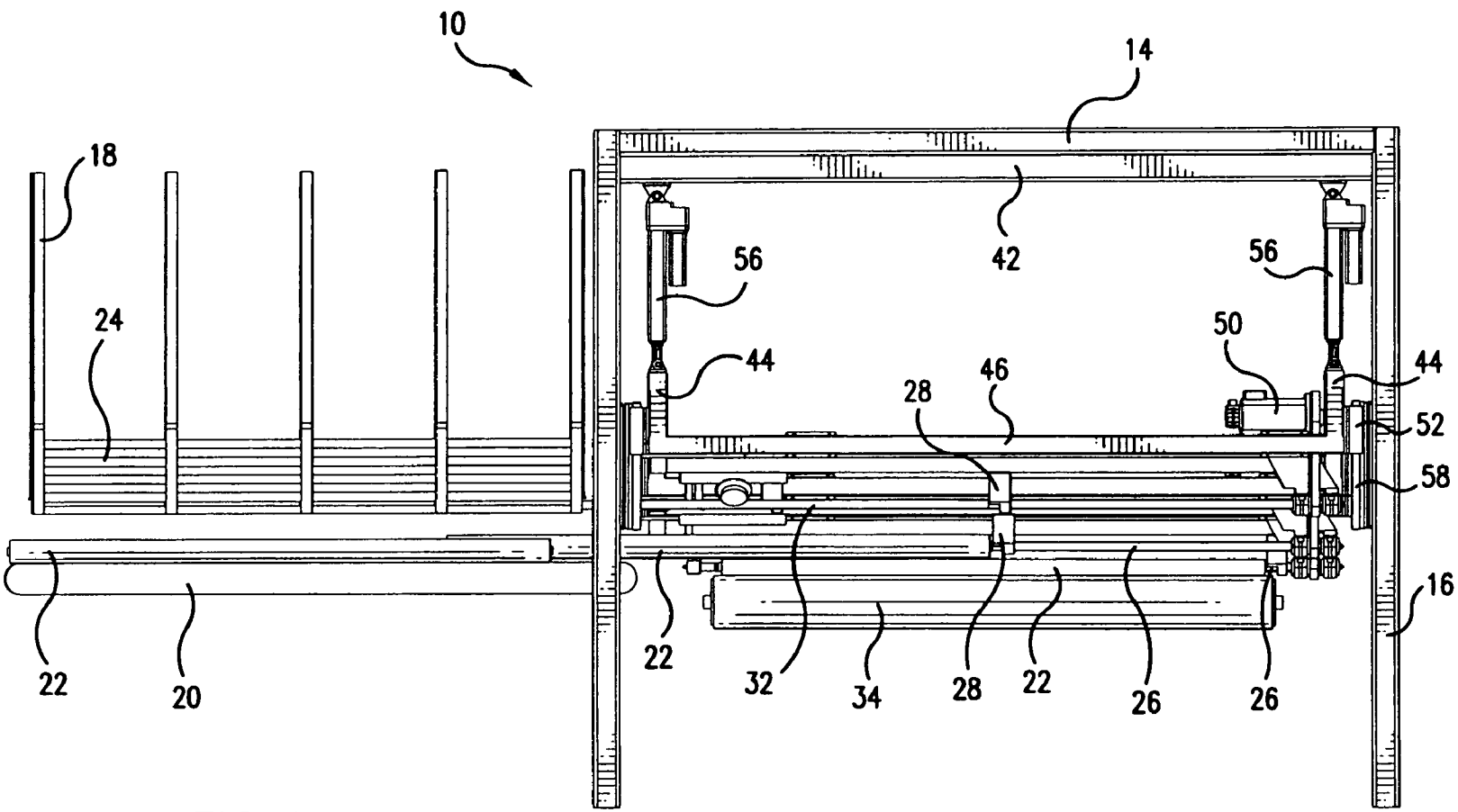
FIG. 4 is a front elevation view of an exemplary embodiment of a winder of the present invention. The drawing shows a plurality of independent winding modules linearly situated with respect to one another and performing the various functions of a log winding cycle.

Each winding module 12 may have a positioning apparatus 56 (FIG. 4). The positioning apparatus 56 moves the winding module perpendicularly with respect to web transport apparatus 34, and in and out of engagement with web 36. Although the modules 12 are shown as being moved in a substantially vertical direction, other exemplary embodiments of the invention may have the modules 12 moved horizontally or even rotated into position with respect to web 36. Other ways of positioning the modules 12 can be envisioned.

Therefore, each of the plurality of independent winding modules 12 may be a self-contained unit and may perform the functions as described with respect to the winding modules 1-6. Winding module 1 may load a core 24 onto the mandrel 26 if a core 24 is desired for the particular rolled product 22 being produced. Next, the winding module 1 may be linearly positioned so as to be in a "ready to wind" position. Further, the mandrel 26 may be rotated to a desired rotational speed and then positioned by the positioning apparatus 56 in order to initiate contact with the web 36. The rotational speed of the mandrel 26 and the position of the winding module 1 with respect to the web 36 may be controlled during the building of the rolled product 22. After completion of the wind, the position of the module 1 with respect to the web 36 will be varied so that the winding module 1 is in a position to effect removal of the rolled product 22. The rolled product 22 may be removed by the product stripping apparatus 28 such that the rolled product 22 is placed on the rolled product transport apparatus 20. Finally, the winding module 1 may be positioned such that it is capable of loading a core 24 onto the mandrel 26 if so desired. Again, if a coreless rolled product were to be produced as the rolled product 22, the step of loading a core 24 would be skipped. It is to be understood that other exemplary embodiments of the present invention may have the core 24 loading operation and the core 24 stripping operation occur in the same or different positions with regard to the mandrel 26.

The rewinder 10 of the present invention may form rolled products 22 that have varying characteristics by changing the type of winding process being utilized. The driven mandrel 26 allows for center winding of the web 36 in order to produce a low density, softer rolled product 22. The positioning apparatus 56 in combination with the web transport apparatus 34 allow for surface winding of the web 36 and the production of a high density, harder wound rolled product 22. Surface winding is induced by the contact between the core 24 and the web 36 to form a nip 68 (shown in FIG. 6) between the core 24 and the web transport apparatus 34. Once started, the nip 68 will be formed between the rolled product 22 as it is built and the web transport apparatus 34. As can be seen, the rewinder 10 of the present invention therefore allows for both center winding and surface winding in order to produce rolled products 22. In addition, a combination of center winding and surface winding may be utilized in order to produce a rolled product 22 having varying characteristics. For instance, winding of the web 36 may be affected in part by rotation of the mandrel 26 (center winding) and in part by nip pressure applied by the positioning apparatus 56 onto the web 36 (surface winding). Therefore, the rewinder 10 may include an exemplary embodiment that allows for center winding, surface winding, and any combination in between. Additionally, as an option to using a motor to control the mandrel speed/torque a braking device (not shown) on the winding modules 12 may be present in order to further control the surface and center winding procedures.

The plurality of independent winding modules 12 may be adjusted in order to accommodate for the building of the rolled product 22. For instance, if surface winding were desired, the pressure between the rolled product 22 as it is being built and the web transport apparatus 34 may be adjusted by the use of the positioning apparatus 56 during the building of the rolled product 22.

Utilizing a plurality of independent winding modules 12 allows for a rewinder 10 that is capable of simultaneously producing rolled product 22 having varying attributes. For instance, the rolled products 22 that are produced may be made such that they have different sheet counts. Also, the rewinder 10 can be run at both high and low cycle rates with the modules 12 being set up in the most efficient manner for the rolled product 22 being built. The winding modules 12 of the present invention may have winding controls specific to each module 12, with a common machine control. Real time changes may be made where different types of rolled products 22 are produced without having to significantly modify or stop the rewinder 10. Real time roll attributes can be measured and controlled. The present invention includes exemplary embodiments that are not limited to the cycle rate. The present invention is also capable of producing a wide spectrum of rolled products 22, and is not limited towards a specific width of the web 36. Also, the plurality of independent winding modules 12 can be designed in such a way that maintenance may be performed on any one or more of the winding modules 1-6 without having to interrupt operation, as previously discussed with winding module 6. A winding module 12 may be removed and worked on while the rest keep running. Further, having a plurality of independent winding modules 12 allows for an increase in the time intervals available for the core 24 loading functions and the rolled product 22 stripping functions. Allowing for an increase in these time intervals greatly reduces the occurrence of loading and stripping errors. Also, prior art apparatuses experiencing interruption of the winding operation will produce a rolled product 22 that is not complete. This waste along with the waste created by the changing of a parent roll or product format change will be reduced as a result of the rewinder 10 in accordance with the present invention. Waste may be removed from the rewinder 10 by use of a waste removal apparatus 200 (FIG. 5) as is known in the art.

Figure 3:
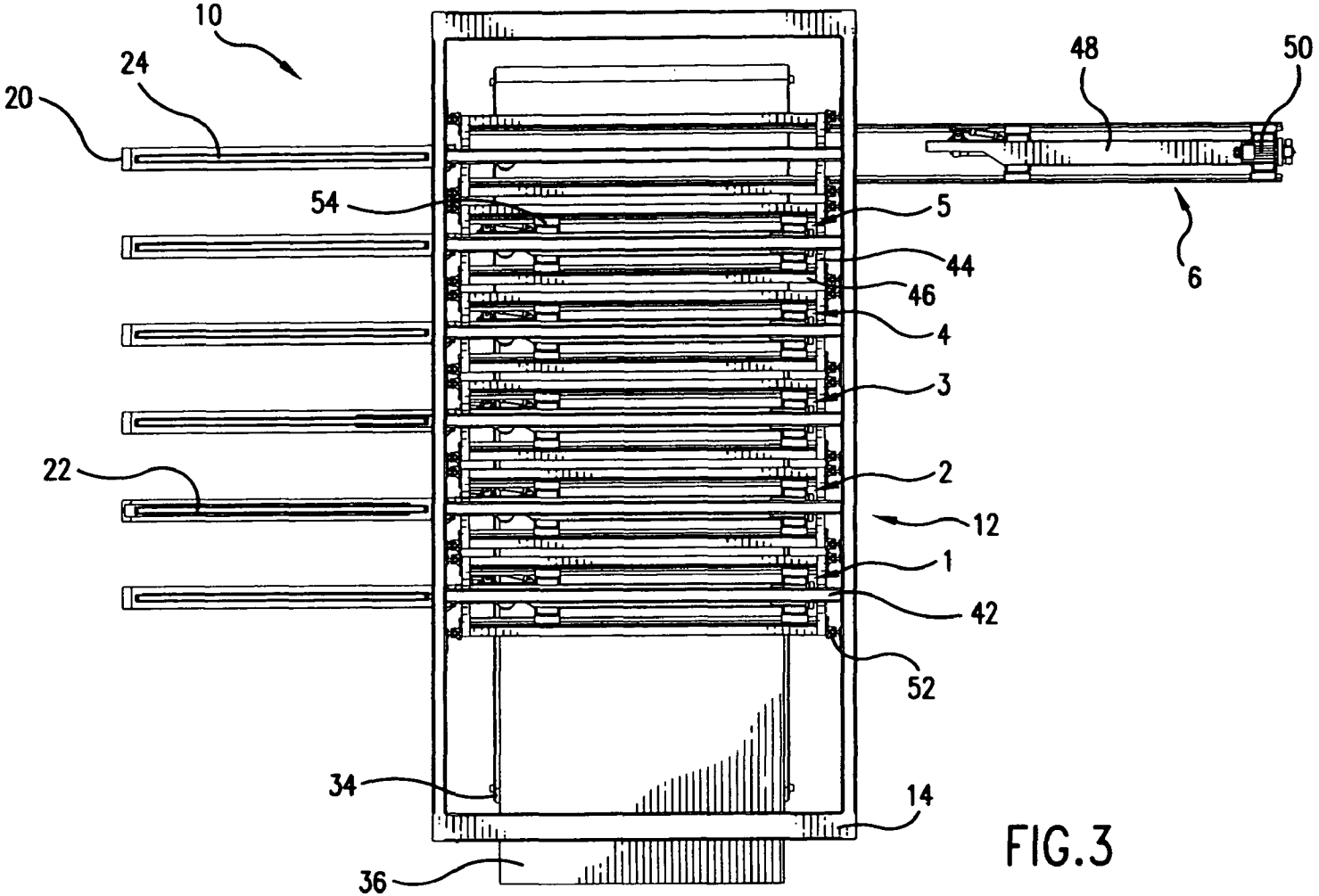
FIG. 3 is a plan view of an exemplary embodiment of a winder of the present invention. The drawing shows a plurality of independent winding modules linearly situated with respect to one another and performing the various functions of a log winding cycle.

FIG. 3 shows a rewinder 10 having a frame 14 disposed about a plurality of independent winding modules 12. The frame 14 has a plurality of cross members 42 transversing the ends of the frame 14. The positioning apparatus 56 that communicates with the winding modules 1-6 is engaged on one end to the cross members 42, as shown in FIG. 4. A vertical linear support member 44 is present on the plurality of independent winding modules 12 in order to provide an attachment mechanism for the positioning apparatus 56 and to provide for stability of the winding modules. The positioning apparatus 56 may be a driven roller screw actuator. However, other means of positioning the plurality of independent winding modules 12 may be utilized. The vertical support members 44 also may engage a vertical linear slide support 58 that is attached to posts 16 on frame 14. Such a connection may be of various configurations, for instance a linear bearing or a sliding rail connection. Such a connection is shown as a vertical linear slide 52 that rides within the vertical linear slide support 58 in FIG. 4.

Figure 6:
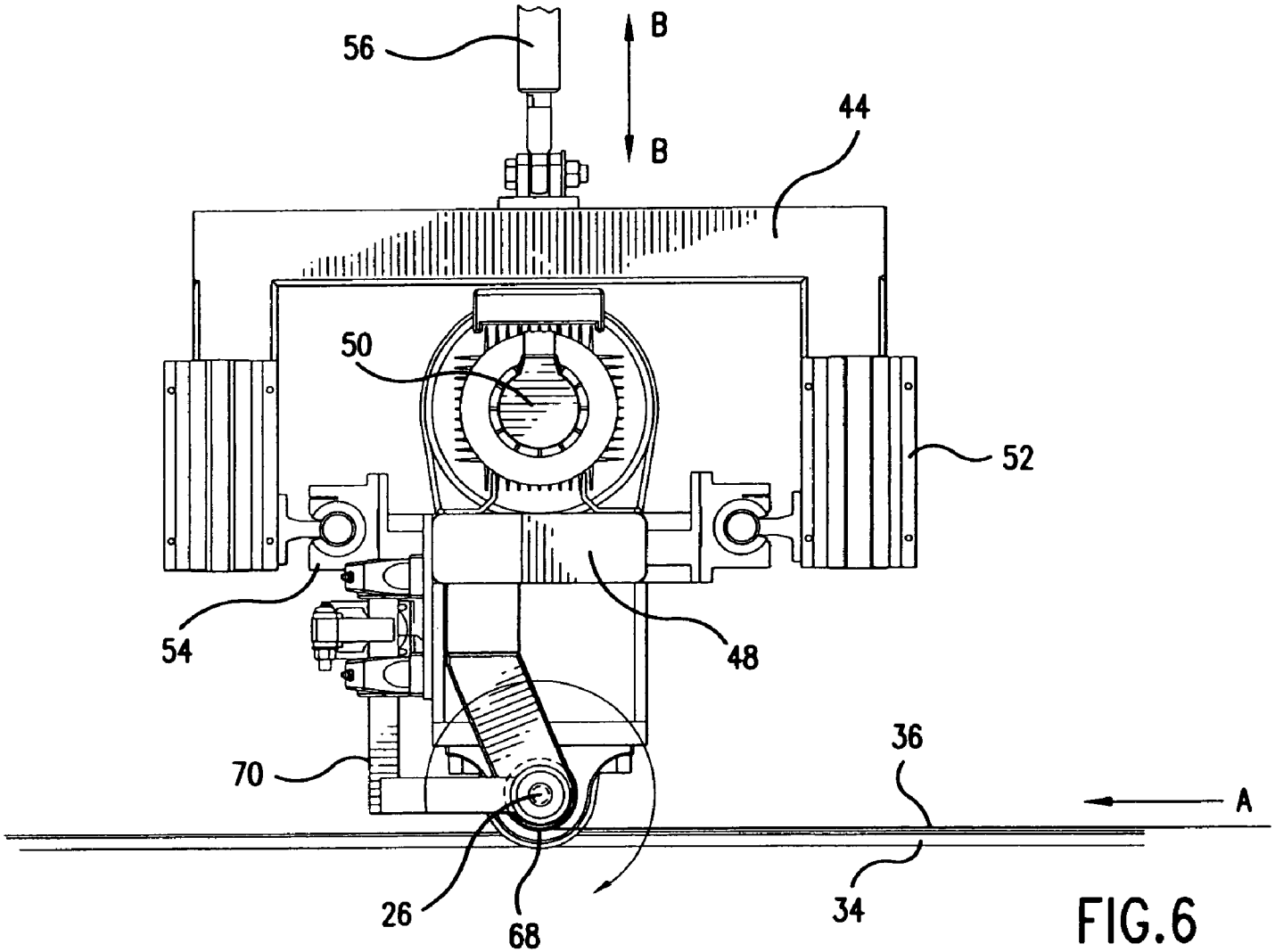
FIG. 6 is a side elevation view of an exemplary embodiment of an independent winding module in accordance with the present invention. The drawing shows the winding module engaging a web and forming a rolled product.

A horizontal linear support member 46 is also present in the plurality of independent winding modules 12. The horizontal linear support member 46 may communicate with a horizontal linear slide 54 (as shown in FIG. 6) to allow some or all of the plurality of independent winding modules 12 to be moved outside of the frame 14. The horizontal linear slide 54 may be a linear rail type connection. However, various configurations are envisioned under the present invention.

FIG. 6 shows a close up view of an exemplary embodiment of a winding module in accordance with the present invention. The servomotor 50 can be supported by the module frame 48 onto which a mandrel cupping arm 70 is configured. The mandrel cupping arm 70 is used to engage and support the end of the mandrel 26 opposite the drive during winding. As can be seen, the positioning apparatus 56 may move the winding module for engagement onto the web 36 as the web 36 is transported by the web transport apparatus 34. Doing so will produce a nip 68 at the point of contact between the mandrel 26 and the transport apparatus 34, with the web 36 thereafter being wound onto the mandrel 26 to produce a rolled product 22.

Figure 7:
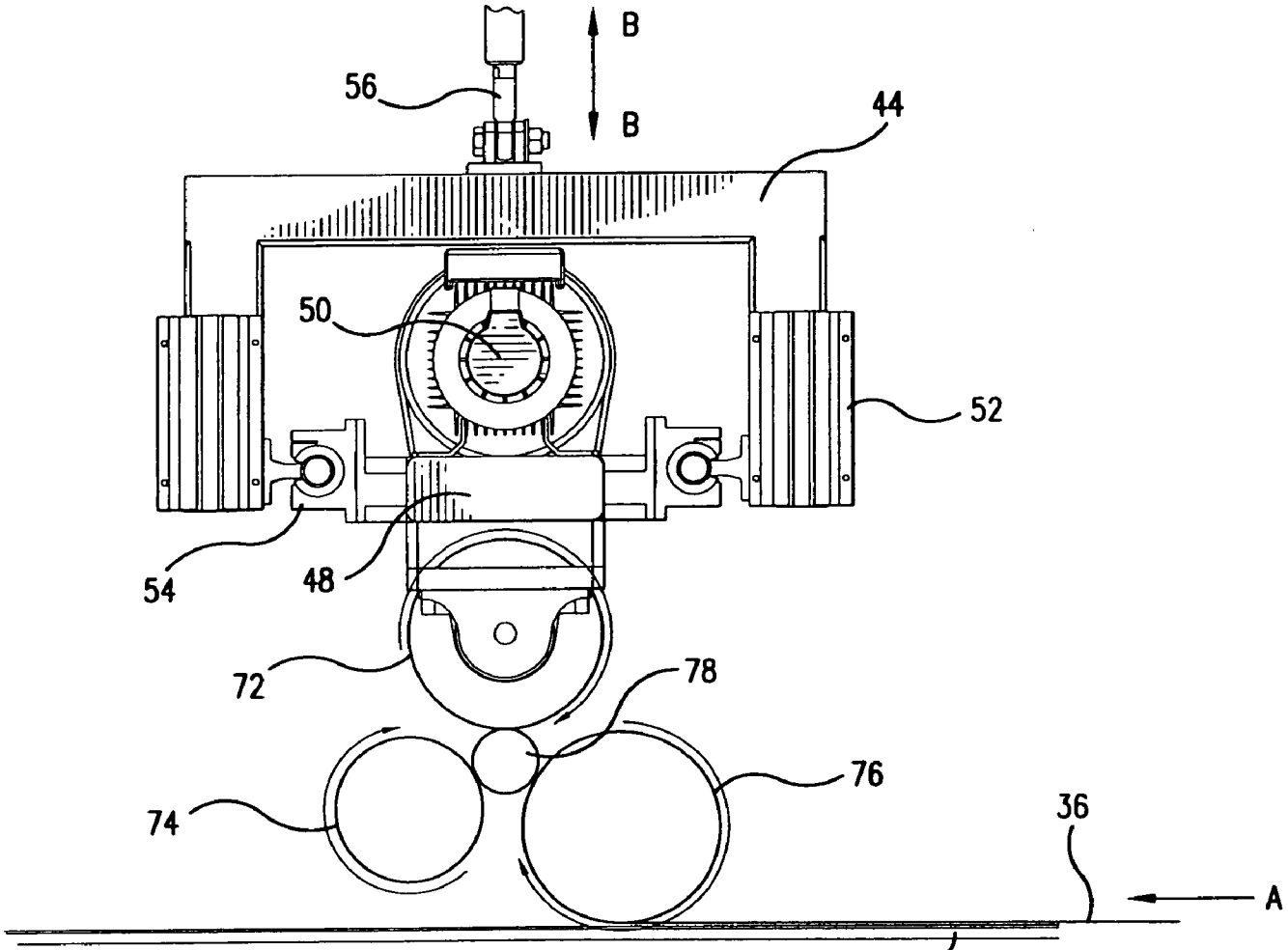
FIG. 7 is a side elevation view of an exemplary embodiment of a winding module in accordance with the present invention. The drawing shows the winding module using rolls to form a rolled product via surface winding only.

FIG. 7 shows another exemplary embodiment of a winder module in accordance with the present invention. The exemplary embodiment in FIG. 7 is substantially similar to the exemplary embodiment shown in FIG. 6 with the exception of having the winding process being a pure surface procedure. A drum roll 72 is located at approximately the same location as the mandrel 26 of FIG. 6. In addition, the exemplary embodiment shown in FIG. 7 also has another drum roll 74 along with a vacuum roll 76. In operation, the web 36 is conveyed by the web transport apparatus 34 in the direction of arrow A. The web transport apparatus 34 may be a vacuum conveyor or a vacuum roll. However, it is to be understood that a variety of web transport apparatus 34 may be utilized, and the present invention is not limited to one specific type. Another exemplary embodiment of the present invention employs a web transport apparatus 34 that is an electrostatic belt that uses an electrostatic charge to keep the web 36 on the belt. The vacuum roll 76 draws the web 36 from the web transport apparatus 34 and pulls it against the vacuum roll 76. The web 36 is then rotated around the vacuum roll 76 until it reaches a location approximately equal distance from the drum roll 72, drum roll 74, and vacuum roll 76. At such time, the web 36 is no longer pulled by the vacuum in the vacuum roll 76 and is thus able to be rolled into a rolled product 22 by way of surface winding by the drum roll 72, drum roll 74, and vacuum roll 76. The rolled product 22 that is formed in the exemplary embodiment shown in FIG. 7 is a coreless rolled product without a cavity 78. The winding module may also be modified such that more than or fewer than three rolls are used to achieve the surface winding process. Further, the production of the rolled product 22 having a core 24 or a coreless cavity in the rolled product 22 can be achieved in other exemplary embodiments using a similar configuration as shown in FIG. 7.

The plurality of winding modules 12 may also be modified such that additional improvements are realized. For instance, a tail sealing apparatus 30 may be included on the plurality of independent winding modules 12. As shown in FIG. 2, the tail sealing apparatus 30 is located on the underside of the plate 48. The tail sealing apparatus 30 may be a series of holes from which an adhesive is sprayed onto the rolled product 22 as the final lengths of the web 36 are rolled onto the rolled product 22. The adhesive causes the tailing end of the web 36 to be adhered to the rolled product 22. It is therefore possible to seal the tail of the rolled product 22 before being unloaded to the rolled product transport apparatus 20. Of course, it may also be possible to provide adhesive to the web 36 at a point other than at the plurality of independent winding modules 12. As stated, for example, adhesive may be applied by the tail sealing module 62 as shown in FIG. 5. Also, it may also be the case that sealing of the tail of the web 36 onto the rolled product 22 may be done offline, beyond the winder.

In order to get the web 36 onto the mandrel 26, the mandrel 26 as shown in FIG. 6, may be a vacuum supplied mandrel. Such a vacuum mandrel 26 will pull the web 36 onto the mandrel 26 by means of a vacuum supplied through all or parts of the vacuum mandrel 26. Other ways of assisting the transfer of the web 36 onto the mandrel 26 are also possible. For instance, an air blast may be provided under the surface of the web transport apparatus 34 or a caming apparatus may be placed under the web transport apparatus 34 to propel the web 36 into contact with the mandrel 26. Further, the positioning apparatus 56 may be used to push the winding module down onto the web 36 to effect the winding. Again, the rewinder 10 of the present invention is thus capable of producing a rolled product 22 which has a core, which is solid without a core or cavity therethrough, or which does not have a core but does have a cavity therethrough. Such a rolled product 22 that is produced without a core 24, yet having a cavity therethrough could be produced by using a vacuum supplied mandrel 26.

FIG. 5 shows an exemplary embodiment of a rewinder 10 that makes use of several modules upstream from the plurality of independent winding modules 12. For instance, a cut-off module 60 is utilized that severs the web 36 once a desired amount of web 36 is transported for the production of a rolled product 22. This severing creates a new leading edge for the next available winding module 1-6 to engage. However, it is to be understood that a cut-off module 60 may be utilized at locations immediately adjacent to or at the nip 68 of the plurality of independent winding modules 12. Also, FIG. 5 shows an adhesive application module 62 on the web transport apparatus 34. This adhesive application module 62 may be an apparatus for applying adhesive or an adhesive tape onto the web 36 in such a fashion that the adhesive would be applied to the tail end of the rolled product 22 sheet. The adhesive application module 62 may apply adhesive to the web 36 so that both the rolled product 22 will be sealed upon completion and the leading edge of the web 36 will have a source of adhesion to transfer to the core of the next successive module. A perforation module 64 is also provided in order to perforate the web 36 such that individual sheets may be more easily removed therefrom.

One particular embodiment of a cut-off module 60 that is particularly well suited to breaking the web 36 while moving is shown in FIG. 15. In particular, the cut-off module 60 as illustrated in FIG. 15 can form a break in the web 36 without having to stop or decelerate the web during the winding process.

As shown, the cut-off module 60 includes a rotating roll 300, such as a vacuum roll that rotates with the web 36 and defines a conveying surface 302. In this embodiment, the vacuum roll 300 is placed adjacent to a guide roll 304 which can receive the web 36 from a parent roll or directly from a papermaking process. Not shown is a perforation module 64. The web 36, however, can be perforated as it is unwound or can be pre-perforated.

As shown in FIG. 15, the cut-off module 60 includes a first rotating arm 306 spaced upstream from a second rotating arm 308. The first rotating arm 306 defines a first contact surface 310 while the second rotating arm 308 defines a second contact surface 312. As shown, the contact surfaces 310 and 312 simultaneously contact the moving web 36 while on the conveying surface 302 when the arms are rotated. In order to rotate the arms 306 and 308, the arms can be mounted onto a bearing and driven by any suitable driving device, such as a motor.

In the embodiment illustrated in FIG. 15, the rotating arms 306 and 308 are shown in an engagement position for breaking the moving web 36 and forming a new leading edge. When the web 36 is being fed into the process, the arms 306 and 308 can be rotated so as to not interfere with the unwinding of the web from the parent roll 304. In particular, the arms 306 and 308 in one embodiment may have a rest position just out of engagement clockwise with the moving web.

When it is desirable to form a break in the web, however, each of the arms 306 and 308 can be rotationally accelerated so that both contact surfaces 310 and 312 contact the moving web on the conveying surface 302 simultaneously. In order for the web to break, however, the second rotating arm 308 is rotated slightly faster than the first rotating arm 306. In this manner, the first rotating arm 306 serves to hold the web against the conveying surface while the second arm 308 pulls and breaks the web. In one embodiment, the arms are spaced a distance and the process is timed so that both contact surfaces 310 and 312 contact the web 36 when there is a perforation line located in between the two contact surfaces. In this manner, the break occurs along the perforation line.

More particularly, in order to form a break in the web, the first arm 306 is accelerated to a speed such that the contact surface 310 contacts the web 36 at a speed that is either slower or at substantially the same speed at which the web is moving.

As described above, the second arm 308 is rotated at a speed such that the contact surface 312 contacts the moving web at a speed greater than at which the first contact surface 310 is moving. For instance, in one embodiment, the second contact surface 312 can be moving at a speed that is from about 2% to about 200% faster than the speed at which the first contact surface 310 is moving. For example, in one particular embodiment, the second contact surface 312 can be moving at a speed that is from about 5% to about 30% faster than the speed at which the first contact surface 310 is moving when contact with the web occurs.

The contact surface 312 of the second arm 308, for instance, can be traveling at a speed that is substantially the same speed at which the web is moving when the speed of the first contact surface 310 is slower than the speed of the web. Alternatively, the second contact surface 312 may be moving at a speed faster than that at which the web is moving.

When the contact surfaces 310 and 312 contact the moving web, in one embodiment, the first contact surface 310 contacts the web prior to the second contact surface 312. Both contact surfaces 310 and 312, however, are generally both in contact with the web as the web is being broken. During the breaking process, the first contact surface 310 holds the web for a brief moment of time while the second contact surface 312 pulls on the web with sufficient force for the break to occur.

The spacing between the first arm 306 and the second arm 308 during contact with the web can vary greatly depending upon the particular type of web material being conveyed and various other factors. For instance, in one embodiment, the contact surfaces 310 and 312 can be spaced from about 1 inch to about 20 inches apart. When processing bath tissue, the contact surfaces, for instance, can be spaced from about 2 inches to about 12 inches apart, such as from about 4 inches to about 8 inches apart, during contact with the web. The spacing, for instance, can be set so that the arms do not interfere with each other and allows for accuracy in placing a perforation line in between the two contact surfaces.

The contact surfaces 310 and 312 can be made from the same material or from different materials. In one embodiment, for instance, the second contact surface 312 can have a higher coefficient of friction than the first contact surface 310. For instance, the second contact surface 312 can be made from a rubber-like material that better grips the web during the breaking process. The first contact surface 310, on the other hand, can be a low friction material that prevents interference with the moving web. For instance, in one embodiment, the first contact material 310 can be made from a textile material, such as a loop material.

The cut-off module 60 as shown in FIG. 15 can provide various advantages and benefits. For instance, by using two contact surfaces 310 and 312, the web 36 can be efficiently and effectively broken and severed over a wide range of web properties and processing conditions. In addition, the two rotating arms as described above place tension only on a short length of the web 36 during the break. In particular, the web is only under tension in between the two contact points of the arms which prevents the moving web from wrinkling, folding or otherwise falling out of misalignment. The cut-off module also provides web control upstream and downstream from the cut-off edge, which minimizes slack in the web in the winding roll that is being finished as well as in the leading portion of the new web for the new roll to be wound. The apparatus also prevents the web from sliding upstream and enables a robust break at high or low speed and at high or low web tension.

Also shown in FIG. 5 is a waste removal apparatus 200 for removing extra web 36 that results from faults such, as web breaks, and machine start ups. This waste is moved to the end of the web transfer apparatus 34 and then removed. The use of a plurality of individual modules 12 reduces the amount of waste because once a fault is detected, the affected module 12 is shut down before the rolled product is completely wound. The web is severed on the fly and a new leading edge is transferred to the next available module. Any waste is moved to the end of the web transfer apparatus 34 and then removed.

It is believed that using a web transport apparatus 34 that has a vacuum conveyor or a vacuum roll will aid in damping the mandrel 26 vibrations that occur during transfer of the web 36 onto the mandrel and also during the winding of the mandrel 26 to form a rolled product 22. Doing so will allow for higher machine speeds and hence improve the output of the rewinder 10.

Each of the winder modules 1-6 of the plurality of independent winding modules 12 do not rely on the successful operation of any of the other modules 1-6. This allows the rewinder 10 to operate whenever commonly occurring problems during the winding process arise. Such problems could include for instance web breaks, ballooned rolls, missed transfers, and core loading errors. The rewinder 10 therefore will not have to shut down whenever one or more of these problems occurs because the winding modules 1-6 can be programmed to sense a problem and work around the particular problem without shutting down. For instance, if a web break problem occurred, the rewinder 10 may perform a web cut by a cut-off module 60 and then initiate a new transfer sequence in order to start a new winding about the next available winding module 1-6. Any portion of the web 36 that was not wound would travel to the end of the web transport apparatus 34 where a waste removal apparatus 200 could be used to remove and transport the waste to a location remote from the rewinder 10. The waste removal apparatus 200 could be for instance an air conveying system. The winding module 1-6 whose winding cycle was interrupted due to the web break could then be positioned accordingly and initiate removal of the improperly formed rolled product 22. Subsequently, the winding module 1-6 could resume normal operation. During this entire time, the rewinder 10 would not have to shut down.

Another exemplary embodiment of the present invention involves the use of a slit web. Here, the web 36 is cut one or more times in the machine direction and each slit section is routed to a plurality of winding modules 12. It is therefore possible to wind the web 36 by two or more modules 12 at the same time.

Exemplary embodiments of the present invention can allow for the winding process to be performed at the back end of a tissue machine. In this way, the tissue web 36 could be directly converted to product sized rolls 22 which in turn would bypass the need to first wind a parent roll during the manufacturing and subsequent rewinding process. Still another exemplary embodiment of the present invention makes use of only a single winding module 12, instead of a plurality of winding modules 12.

The exemplary embodiment of the rewinder shown in FIG. 5 is one possible configuration for the movement of the plurality of independent winding modules 12. A positioning apparatus member 66 is present and is attached to the frame 14. The positioning apparatus member 66 extends down to a location proximate to the winding location of the web 36. The plurality of independent winding modules 12 are slidably engaged with the positioning apparatus member 66 so that the center, surface, or center/surface winding procedure can be accomplished. It is to be understood that alternative ways of mounting and sliding the plurality of independent winding modules 12 in a vertical direction can be accomplished by those skilled in the art. The plurality of independent winding modules 12 of FIG. 5 are arranged in a substantially linear direction. In addition, the web transport apparatus 34 is also linear in orientation at the location proximate to the plurality of independent winding modules 12. The embodiments depicted are of an orientation of the web transport device in a substantially horizontal plane. However, it should be realized that any orientation other than horizontal could be utilized. Furthermore, the embodiments depicted utilize modules that only engage one side of the web transport apparatus. It should be understood that a winder could be configured where the winding modules engage more than one side of the web transport apparatus.

Figure 8:
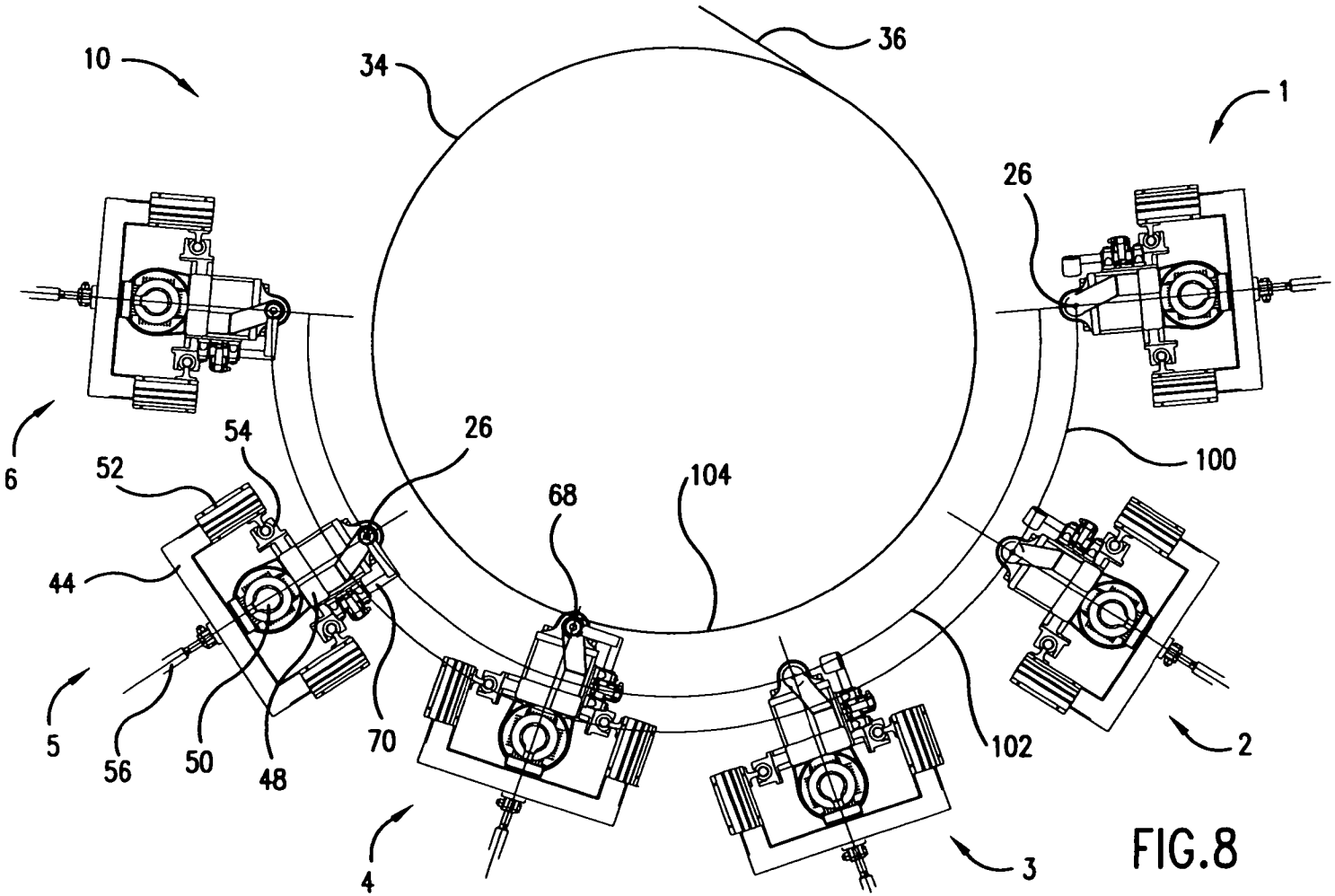
FIG. 8 is a side elevation of an exemplary embodiment of a winder in accordance with the present invention. The drawing shows a plurality of independent winding modules being radially situated with respect to one another and interacting with a circular web transport apparatus.

FIG. 8 shows an alternative configuration of both the web transport apparatus 34 and the plurality of independent winding modules 12. The exemplary embodiment shown in FIG. 8 is a plurality of winding modules 12 that are radially disposed with respect to one another, and a web transport apparatus 34 that is cylindrical in shape. The web transport apparatus 34 in this case can be, for instance, a vacuum roll. Each of the winding modules 1-6 are arranged about the web transport apparatus 34 such that the winding modules 1-6 are moved towards and away from the web transport apparatus 34 by the positioning apparatus 56.

The operation of the exemplary embodiment shown in FIG. 8 is substantially similar to that as previously discussed. Winding module 1 is shown in the process of loading a core 24. The mandrel 26 of winding module 1 has a distance from the center of the web transport apparatus 34 designated as a core loading position 100. Winding module 3 is shown in the process of stripping a rolled product 22. The center of the mandrel 26 of winding module 3 is located at a stripping position 102 from the center of the web transport apparatus 34. Winding module 4 is shown in the process of engaging the web 36 and winding the web 36 onto the core 24, that is loaded on the driven mandrel 26, to form a rolled product 22. A nip 68 is formed between the core 24, that is loaded on mandrel 26, and the web transport apparatus 34. The nip 68 is located at a winding position 104 at a distance from the center of the web transport apparatus 34.

Winding modules 2 and 6 are located at the core loading position 100. However, these modules may be positioned such that maintenance can be performed on them, or be in the "ready to wind" position. Module 5 is at the stripping position 102. However, module 5 may also be in the process of just completing the stripping of a rolled product 22.

Figure 9:
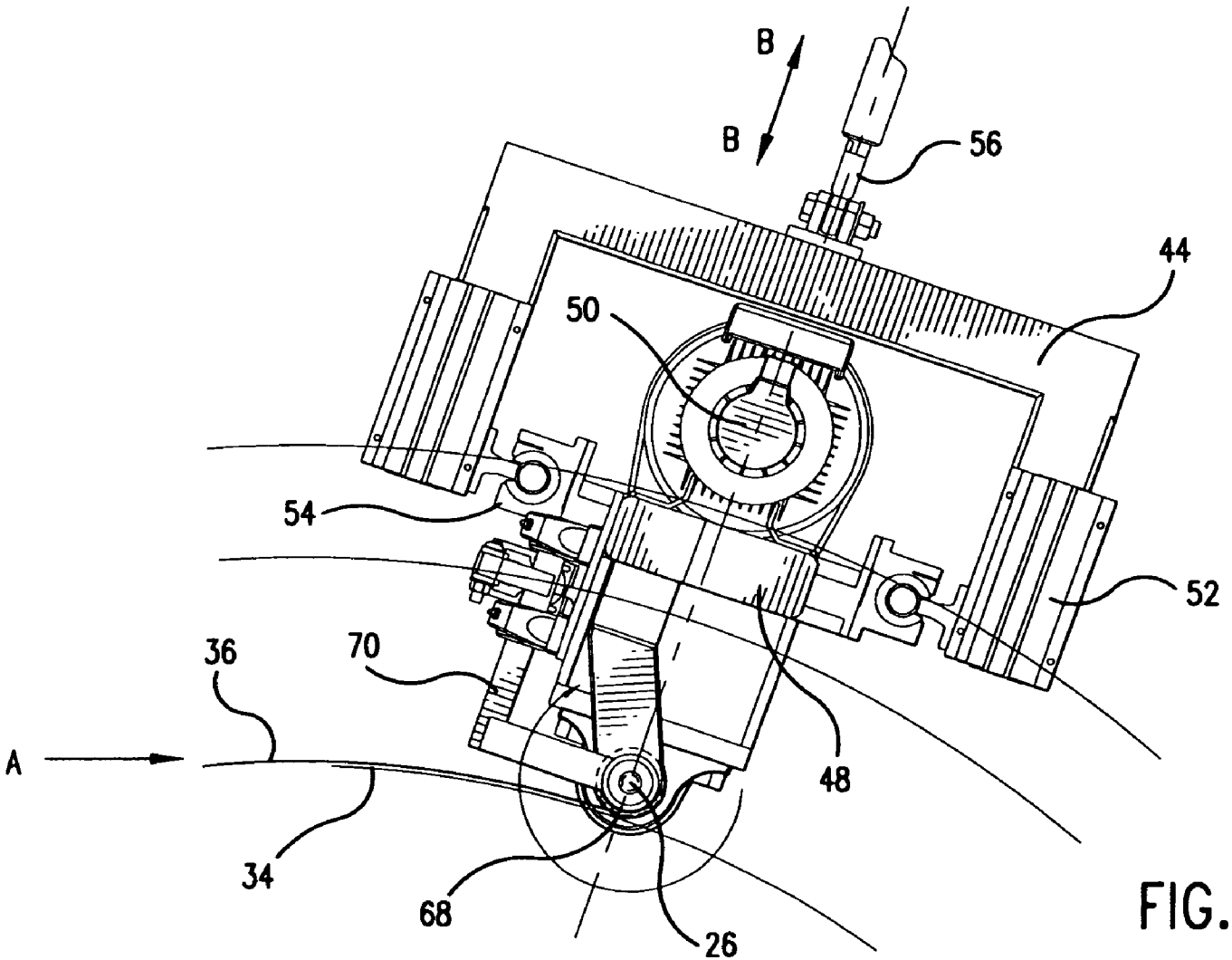
FIG. 9 is a side elevation view of an exemplary embodiment of an independent winding module in accordance with the present invention. The drawing shows a winding module that interacts with a circular web transport apparatus.

FIG. 9 discloses an exemplary embodiment of a winding module that is used in the configuration disclosed in FIG. 8. The winding module of FIG. 9 is substantially the same as the winding module shown in FIG. 6, although configured for a circular array configuration as opposed to a linear array configuration.

It should be understood that the invention includes various modifications that can be made to the exemplary embodiments of the center/surface rewinder/winder described herein as come within the scope of the appended claims and their equivalents. Further, it is to be understood that the term "winder" as used in the claims is broad enough to cover both a winder and a rewinder.

What is claimed:

1. An apparatus for breaking a moving web comprising:

a conveying surface over which a moving web is conveyed;

a first rotating arm configured to rotate about a first axis, and a second rotating arm configured to rotate about a second axis, wherein the first and second arm are positioned adjacent to the conveying surface, the first rotating arm being spaced upstream from the second rotating arm with respect to a moving web, the first rotating arm defining a first contact surface that contacts the conveying surface when the first rotating arm is rotated, the second rotating arm defining a second contact surface that also contacts the conveying surface when the second rotating arm is rotated;

wherein, in order to break a moving web on the conveying surface, both rotating arms are rotated causing each of the respective contact surfaces to contact the moving web on the conveying surface at or near the same time, the second rotating arm being configured to rotate at a speed faster than the first rotating arm during contact with the moving web causing the moving web to break in between the first and second contact surfaces, and wherein the first and second axis respectively and the conveying surface are at a fixed position relative to one another and remain at said fixed position relative to each other at all times during conveying of the web such that the first rotating arm and second rotating arm are configured to contact and break the moving web with each full revolution about the first and second axis respectively.

2. An apparatus as defined in claim 1, wherein the conveying surface comprises a roll that rotates with a moving web.

3. An apparatus as defined in claim 2, wherein the roll comprises a vacuum roll that holds a moving web onto the conveying surface.

4. An apparatus as defined in claim 1, wherein the first rotating arm is configured to be rotating at a speed such that the speed of the first contacting surface substantially matches the speed of the moving web.

5. An apparatus as defined in claim 1, wherein the second rotating arm is configured to rotate at a speed such that the second contact surface contacts the conveying surface at a speed that is 2% to 200% faster than the speed at which the first contact surface is moving during contact with the conveying surface.

6. An apparatus as defined in claim 1, wherein the first rotating arm and the second rotating arm are spaced from one another such that the first contact surface contacts the conveying surface at a distance of from 4 inches to 8 inches upstream from where the second contact surface contacts the conveying surface.

7. An apparatus as defined in claim 1, wherein the second contact surface has a greater coefficient of friction than the first contact surface.

8. An apparatus as defined in claim 1, wherein the first rotating arm is configured to be rotating at a speed such that the speed of the first contacting surface is slower than the speed of the moving web and wherein the second rotating arm is configured to be rotating at a speed such that the speed of the second contacting surface substantially matches the speed of the moving web.

9. A winder for winding a web to produce a rolled product comprising:

an unwind station for unwinding a web;

a web transport apparatus for conveying a web downstream from the unwind station, the web transport apparatus comprising a conveyor belt;

a plurality of winding modules positioned along the web transport apparatus, each winding module comprising:

a) a mandrel in operative association with a driving device for rotating the mandrel; and b) a positioning apparatus in operative association with the mandrel, the positioning apparatus being configured to move the mandrel into and out of engagement with the conveyor belt, wherein, when placed in engagement with the conveyor belt, a nip is formed between the mandrel and the conveyor belt;

wherein the mandrels are consecutively positioned along the web transport apparatus, the nip between the mandrel and the conveyor belt being used to contact a web being conveyed on the conveyor belt in order to initiate winding of the web on the mandrel;

and wherein the winder further includes the apparatus for breaking the moving web as defined in claim 1, the apparatus for breaking the moving web being positioned adjacent to the unwind station and being configured to break the web in order to form a new leading edge for initiating winding of the web on one of the mandrels.

10. A winder as defined in claim 9, wherein each mandrel is movably positioned so that the distance between the mandrel and the web transport apparatus is varied so as to produce the nip having a nip pressure, a web being wound into a rolled product by combination of mandrel rotational speed, web surface speed, incoming web tension, and the nip pressure.

11. A winder as defined in claim 9, wherein each winding module further comprises a core loading apparatus for loading a core onto a respective mandrel.

12. A process for breaking a moving web without stopping the web comprising:

conveying the moving web on a conveying surface;

rotating a first arm about a first axis and a second arm about a second axis into simultaneous contact with the moving web on the conveying surface, the first rotating arm defining a first contact surface that contacts the moving web and the second rotating arm defining a second contact surface that contacts the moving web, the first contacting surface contacting the moving web upstream from the second contact surface, and wherein the second contact surface contacts the moving web while rotating at a speed faster than the speed at which the first contact surface is rotating causing the web to break in between the first contact surface and the second contact surface;

wherein the first and second axis respectively and the conveying surface are at a fixed position relative to one another and remain at said fixed position relative to each other at all times during conveying of the web, the first arm and second arm being configured to break the moving web with each full revolution about the first and second axis respectively.

13. A method as defined in claim 12, wherein the moving web is perforated to form at least one perforation line that extends perpendicular to the direction in which the web is moving, the perforation line being spaced in between the first contact surface and the second contact surface during contact with the moving web causing the web to break along the perforation line.

* * * * *